US005833536A

United States Patent [19]

Davids et al.

[11] Patent Number: 5,833,536

[45] Date of Patent: Nov. 10, 1998

[54] SYSTEM FOR PLAYING ELECTRONICS CARD GAME WITH PLAYER SELECTION OF CARDS IN MOTION ON DISPLAY

[75] Inventors: Robert E. Davids, Fo Tan, Hong Kong; Forrest D. Wolf; Jon N. Bengston, both of Reno, Nev.

[73] Assignee: International Game Technology, Reno, Nev.

[21] Appl. No.: 704,185

[22] Filed: Aug. 28, 1996

Related U.S. Application Data

[60] Provisional application No. 60/006,799 Nov. 15, 1995.

[51] Int. Cl.[6] ..... A63F 9/00

[52] U.S. Cl. ..... 463/11

[58] Field of Search ..... 463/9, 10, 11, 463/12, 13, 30, 31, 33; 273/459, 460

[56] References Cited

U.S. PATENT DOCUMENTS

| | | | |
|---|---|---|---|
| 3,735,982 | 5/1973 | Gerfin | 273/1 E |
| 3,889,956 | 6/1975 | Castle | 273/138 A |
| 4,475,564 | 10/1984 | Koester et al. | 133/8 R |
| 4,743,022 | 5/1988 | Wood | 273/85 CP |
| 4,837,728 | 6/1989 | Barrie et al. | 364/412 |
| 5,014,988 | 5/1991 | Mirando et al. | 273/125 A |
| 5,014,991 | 5/1991 | Mirando et al. | 273/138 A |
| 5,019,973 | 5/1991 | Wilcox et al. | 364/412 |
| 5,033,744 | 7/1991 | Bridgeman et al. | 273/85 CP |
| 5,042,818 | 8/1991 | Weingardt | 273/292 |
| 5,046,736 | 9/1991 | Bridgeman et al. | 273/85 CP |
| 5,098,107 | 3/1992 | Baylan et al. | 273/292 |
| 5,100,137 | 3/1992 | Fulton | 273/85 CP |
| 5,167,413 | 12/1992 | Fulton | 273/85 CP |
| 5,188,363 | 2/1993 | Marnell, II et al. | 273/85 |
| 5,224,706 | 7/1993 | Bridgeman et al. | 273/85 |
| 5,242,163 | 9/1993 | Fulton | 273/85 CP |
| 5,249,800 | 10/1993 | Hilgendorf et al. | 273/138 A |
| 5,251,897 | 10/1993 | Fulton | 273/85 CP |
| 5,255,915 | 10/1993 | Miller | 273/85 CP |
| 5,259,613 | 11/1993 | Marnell, II | 273/138 A |
| 5,265,888 | 11/1993 | Yamamoto et al. | 273/434 |
| 5,275,400 | 1/1994 | Weingardt et al. | 273/85 CP |
| 5,277,424 | 1/1994 | Welms | 273/85 CP |
| 5,294,120 | 3/1994 | Schultz | 273/85 CP |
| 5,308,065 | 5/1994 | Bridgeman et al. | 273/85 CP |
| 5,332,219 | 7/1994 | Marnell, II et al. | 273/138 A |
| 5,332,228 | 7/1994 | Schultz | 273/292 |
| 5,342,047 | 8/1994 | Heidel et al. | 273/85 |
| 5,356,140 | 10/1994 | Dabrowski et al. | 273/85 |
| 5,374,067 | 12/1994 | Jones | 273/292 |
| 5,377,973 | 1/1995 | Jones et al. | 273/85 CP |
| 5,382,025 | 1/1995 | Sklansky et al. | 273/292 |
| 5,393,057 | 2/1995 | Marnell, II | 273/85 CP |
| 5,401,023 | 3/1995 | Wood | 273/85 CP |
| 5,407,199 | 4/1995 | Gumina | 273/139 |
| 5,411,257 | 5/1995 | Fulton | 273/85 CP |

OTHER PUBLICATIONS

Wellrris ™ Player's Guide, ©1989 Doka pp. 1, 4–15.

*Primary Examiner*—George Manuel
*Attorney, Agent, or Firm*—Roylance, Abrams, Berdo & Goodman, L.L.P.

[57] ABSTRACT

A game machine is provided which comprises a display device, a processor connected to the display device and a user input device connected to the processor. The processor is programmed to generate images of playing cards moving from a point on the display device toward a plurality of card hand locations displayed on the display device. To play a card game such as poker on the game machine, a player uses the user input device to select a moving card and direct its movement toward a selected card position in a selected one of the card hand locations. If the player does not select and direct a moving card before a predetermined period of time elapses (e.g., as determined by the time required for a card to travel a predetermined distance), the processor automatically places the card in one of the card hand locations.

14 Claims, 41 Drawing Sheets

SYSTEM FOR PLAYING ELECTRONICS CARD GAME WITH PLAYER SELECTION OF CARDS IN MOTION ON DISPLAY

This application claims the benefit of U.S. Provisional application No 60/006,799, filed Nov. 15, 1995.

FIELD OF THE INVENTION

The invention relates to a system for playing electronic card games and, more particularly, to an electronic card game machine which generates images of cards in motion on a display and allows a player to select a card and place the card in one of a plurality of card hands.

BACKGROUND OF THE INVENTION

A number of mechanical and/or electronically controlled poker games exist which seek to increase the excitement of playing poker by providing a player with different options for receiving, drawing and discarding cards in a hand, progressive payouts, and different wagering strategies. See, for example, U.S. Pat. No. 5,374,067, to Jones, U.S. Pat. No. 5,356,140, to Dabrowski, U.S. Pat. No. 5,382,025, to Sklansky et al, U.S. Pat. No. 5,377,937, to Jones, U.S. Pat. Nos. 5,332,228 and 5,294,120, to Schultz, U.S. Pat. No. 5,255,915, to Miller, as well as U.S. Pat. Nos. 5,224,706, 5,308,065, 5,046,736 and 5,033,744, to Bridgeman.

A number of other existing electronically controlled card games increase player excitement by limiting the time period during which the player can respond to a certain event in a card game. For example, U.S. Pat. No. 3,735,982, to Gerfin, discloses a game machine comprising a number of projector systems for projecting a corresponding number of images of cards on a screen. A player is required to make a card selection within a predetermined amount of time before the respective one of the projector systems produces a transparency image of another card. U.S. Pat. No. 5,188,363, to Marnell II, discloses a game machine having cards displayed on a wheel of fortune and an arrangement of lights for selectively illuminating each card. The cards are illuminated in sequence automatically by a central processing unit. A player is required to select five of the sequentially illuminated cards for his or her poker hand within a predetermined time period; otherwise, the central processing unit automatically selects the cards to be placed in the player's poker hand.

Other electronic games exist which also require a player to play a game within certain time constraints, but do not involve cards characterized by indicia such as numbers and suits (e.g., hearts, clubs, spades and diamonds). For example, WELLTRIS™ software available from Spectrum HoloByte for personal computers generates images of game pieces falling down the sides of a well displayed on a personal computer monitor. The game pieces are geometrically shaped and may exist in clusters of two, three, four and sometimes five pieces. A player depresses buttons on the keyboard to control the orientation of the game pieces or clusters as they descend toward the bottom of the screen to form continuous segments of game pieces either horizontally or vertically at the bottom of the well. The software eliminates continuous segments of game pieces. The object of the game is to minimize the number of game pieces at the bottom of the well. The U.S. Pat. No. 5,265,588, to Yamamoto et al, is similar to the WELLTRIS™ software in that a game machine generates images of capsules descending from the top of a computer monitor toward the bottom of the screen. The game machine also generates images of a second type of object, that is, a virus or a bug. The object of the game is similarly to stack the capsules in continuously aligned segments, the difference being that the capsules can be aligned with viruses of the same color. A prescribed number of objects (e.g., four) of the same type (e.g., capsules and/or virus of the same color) that are aligned continuously in the vertical or lateral direction results in the erasure of that line from the bottom of the screen.

SUMMARY OF THE INVENTION

In accordance with an aspect of the present invention, a game machine is provided which generates an image of a moving card and allows a player to control the placement of the moving card into a card hand.

In accordance with another aspect of the present invention, a game machine is provided which generates an image of a moving card and allows a player to control the placement of the moving card into a selected one of a plurality of card game hands.

In accordance with yet another aspect of the invention, a game machine is provided which generates an image of a card descending from the top of a display screen toward the bottom thereof and allows a user to redirect the card to a particular location on the screen. The descending card automatically stops at a predetermined location on the screen if the player does not successfully redirect the card to another selected screen location before the card reaches the predetermined location.

BRIEF DESCRIPTION OF THE DRAWINGS

These and other features and advantages of the present invention will be more readily apprehended from the following detailed description when read in connection with the appended drawings, which form a part of this original disclosure, and wherein.

DETAILED DESCRIPTION OF THE PREFERRED EMBODIMENTS

Figure 1:
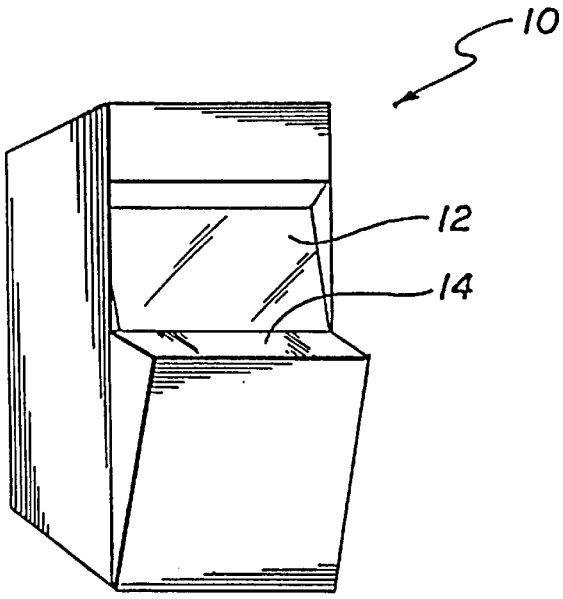
FIG. 1 is an isometric view of an electronic game machine constructed in accordance with an embodiment of the present invention.
Figure 6:
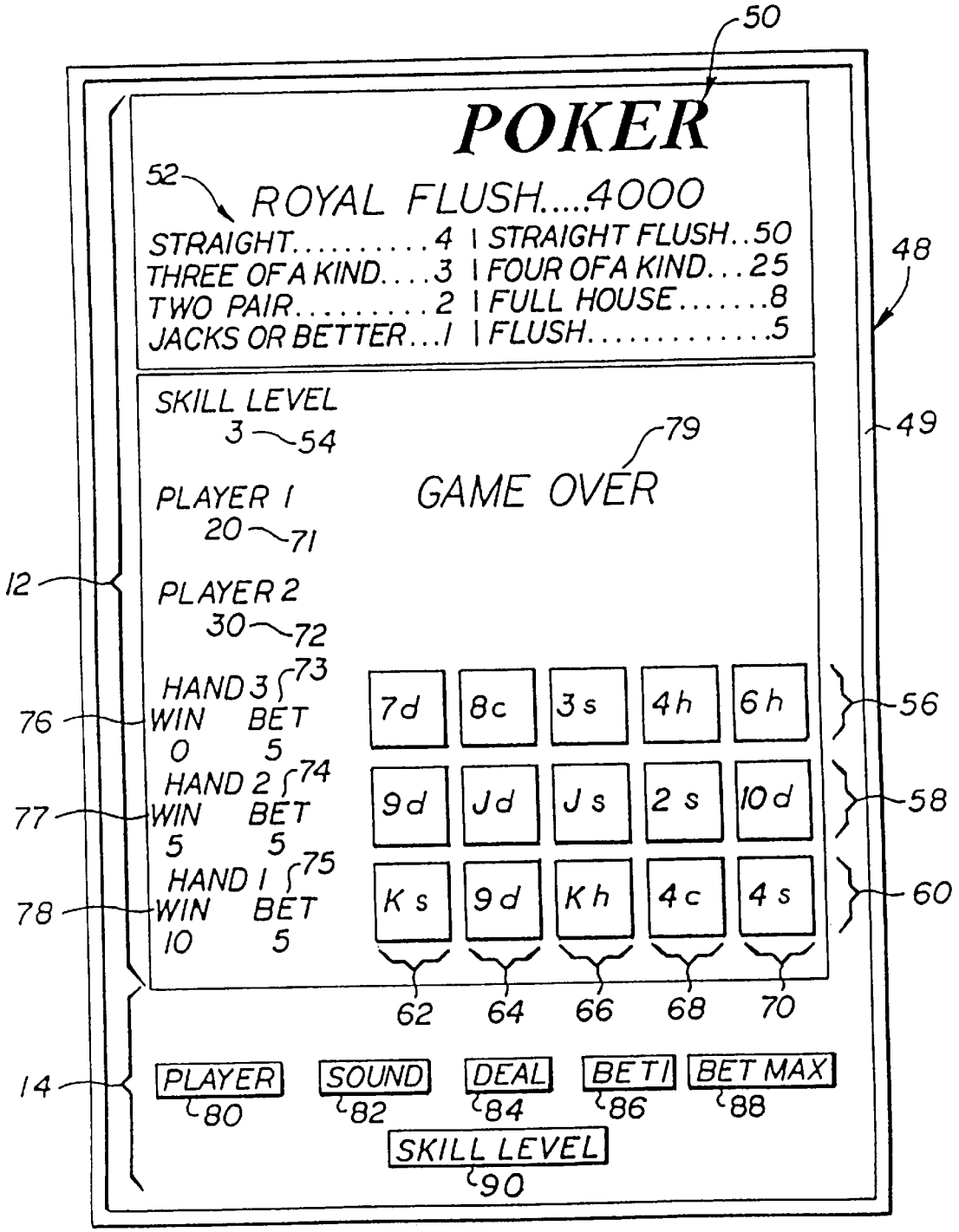
FIGS. 6–22 are screens generated by a game machine in accordance with an embodiment of the present invention.

FIG. 1 depicts a game machine 10 constructed in accordance with an embodiment of the present invention. The game machine 10 is illustrated as a stand-alone unit with a display 12 and a control panel 14 which are arranged at respective heights for use by a player who is standing and facing the display. In accordance with other embodiments of the present invention, the game machine 10 can be configured as a pub-style table-top game (not shown) having a display for viewing by a player in a seated position and a control panel that can accessed while seated. The game machine 10 can also be implemented as program code stored in a detachable cartridge for operating a hand-held video game device, or as program code stored on a disk or other memory device for use in a personal computer or other computerized platform. If the game machine 10 is configured as a personal computer, for example, the display device 12 and the control panel 14 can both be provided by a single computer-generated screen. The control panel 14 comprises on-screen buttons, as shown in FIG. 6, which are activated by a mouse or light pen or by a player touching the screen, if the screen is a touchscreen.

Figure 2:
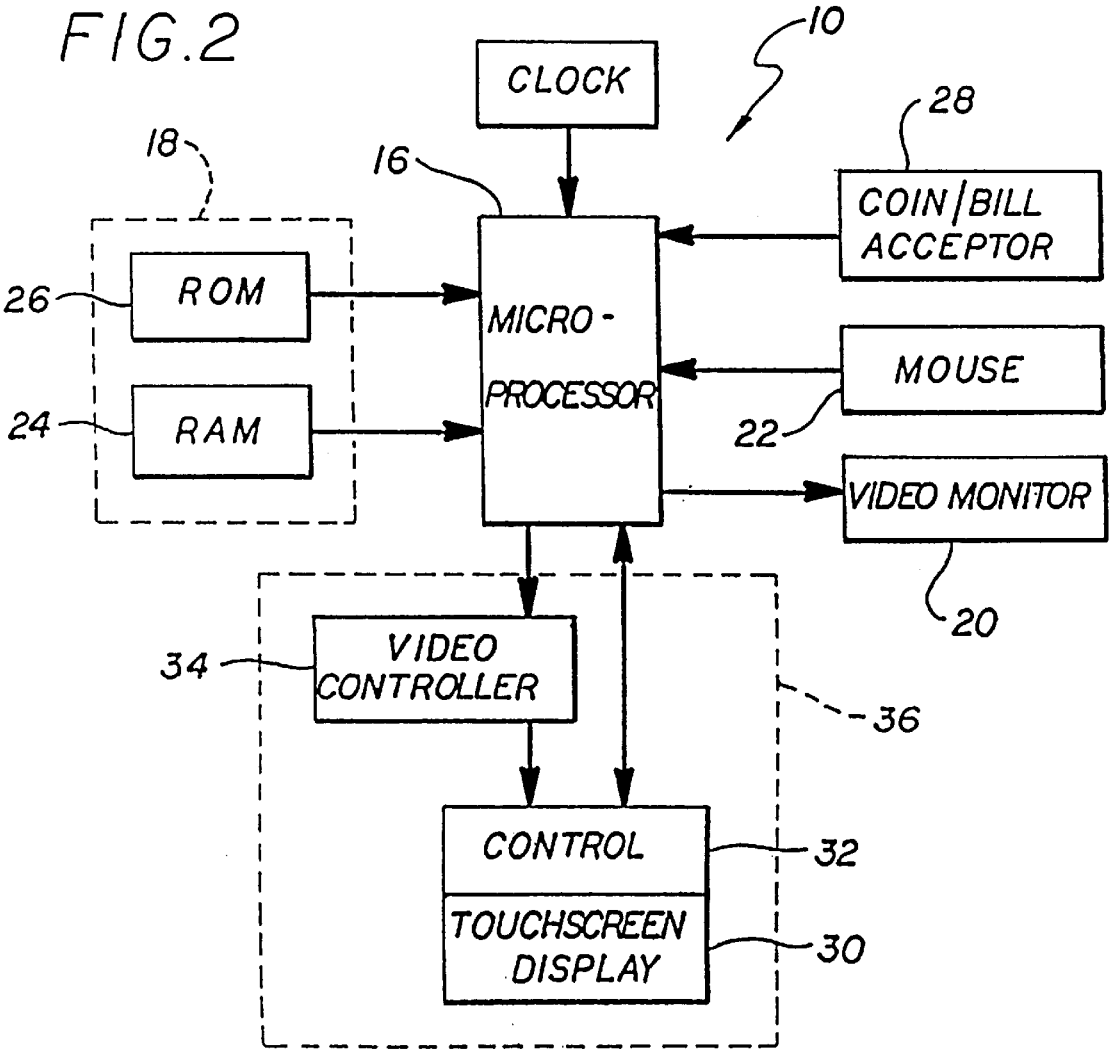
FIG. 2 is a schematic block diagram of a control circuit for a game machine constructed in accordance with an embodiment of the present invention.

With reference to FIG. 2, the game machine 10 comprises a processor 16, a memory device 18 for storing program code and other data, a video monitor 20 or other display device (e.g., a liquid crystal display), and at least one input device such as a mouse 22. Alternatively, a touchscreen or other point and select device, or a game play switch (e.g., an electromechanical button or relay) can be used. The processor 16 is preferably a microprocessor or microcontroller-based platform that is capable of interfacing with various input and output devices such as a touchscreen 30 and a video monitor 20, respectively. The display device 20 is preferably capable of displaying alphanumeric characters and symbols (e.g., the diamond, spade, hearts and clover suits of a deck of conventional playing cards). The memory device 18 can comprise random access memory (RAM) 24 for storing event data and other data generated or used during a particular game and a read only memory (ROM) 26 for storing program code for controlling the game machine to play a particular game in accordance with selected game rules and pay tables.

With continued reference to FIG. 2, the processor 16 can be connected to a bill or coin acceptor 28. The processor 16 can be programmed to require receipt of a signal from the bill or coin receptor 28 which indicates that a required amount of money has been deposited therein by a player before the processor can commence an electronic game. As stated previously, a touchscreen 30 and an associated touchscreen controller 32 can be used in lieu of a conventional video monitor 20 and user input device such as a mouse 22 to receive player control signals, in accordance with an alternative embodiment of the present invention. As shown in the phantom box 36, the touchscreen 30 and the touchscreen controller 32 are connected to a video controller 34, as well as to the processor 16.

Exemplary screens generated by the processor 16 on the display device 20 are depicted in FIGS. 6 through 22. As will be described in connection with FIG. 3, the processor 16 is programmed to generate screens on the display device 20 and to respond to a player's manipulation of the input device(s) 22 in accordance with the rules of an electronic card game involving cards or other indicia-bearing game pieces in motion on the screen.

Figure 3:
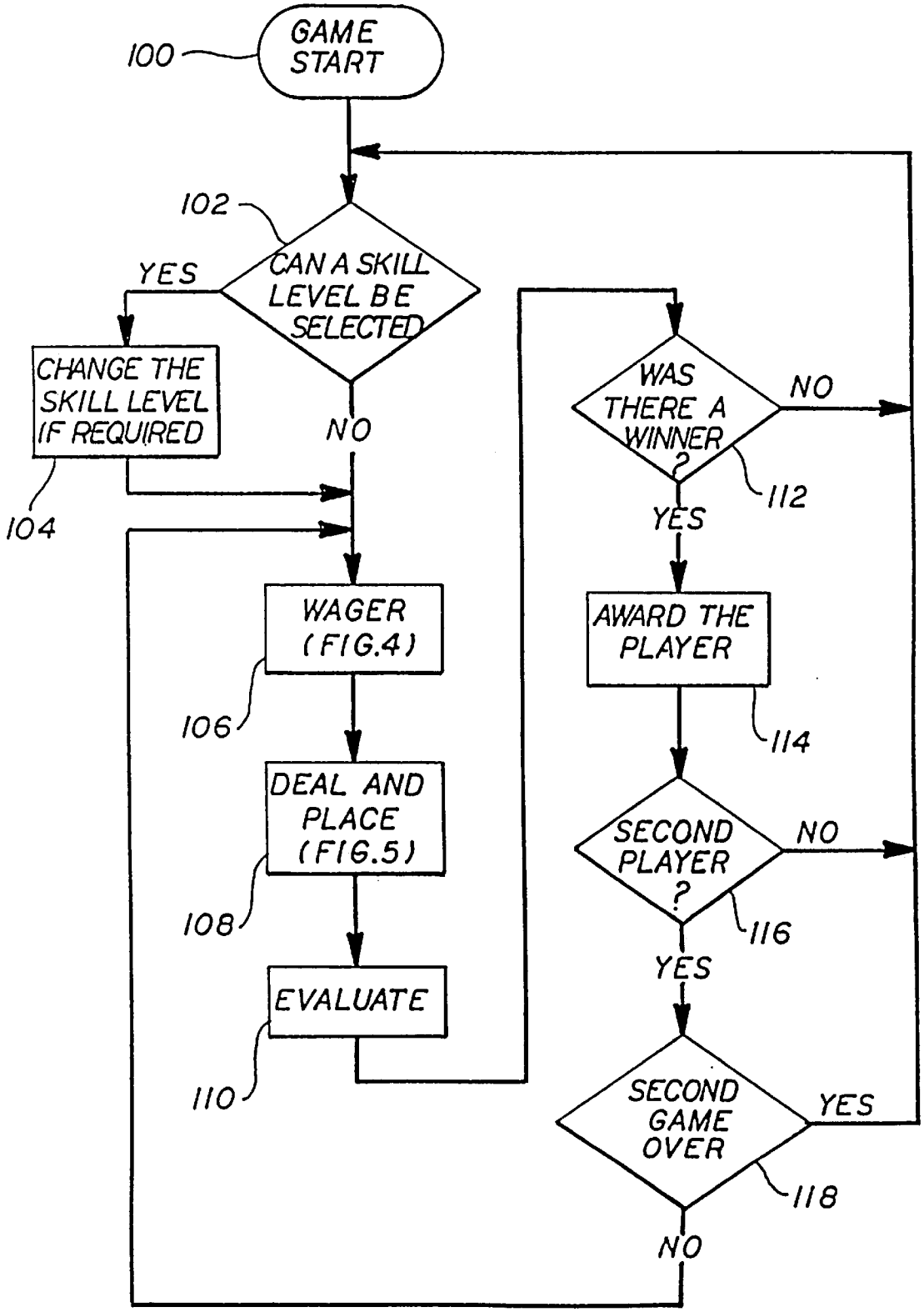
FIGS. 3–5 are flow charts depicting a sequence of operations for playing a card game using an electronic game machine in accordance with an embodiment of the present invention.

As indicated by block 100 in FIG. 3, the processor 16 is programmed to generate an initial game screen 48, as shown in FIG. 6, at the start of each game and when the game machine is not in use for more than a predetermined period of time. The initial game screen 48 preferably indicates the title of the electronic game 50 (e.g., POKER), the payout schedule 52 for different poker game card hands, and a skill level indicator 54 for the player(s). Further, the initial game screen 48 in FIG. 6 displays two or more card hands, e.g., card hands 56, 58 and 60. Each of the card hands 56, 58 and 60 comprises a number of card positions (e.g., five card positions 62, 64, 66, 68 and 70). The individual cards are from a conventional deck of cards comprising four suits (i.e., diamonds denoted as "d", spades denoted as "s", clover denoted as "c" and hearts denoted as "h'), each ranging alphanumerically from an ace "a", 1–9, jack "j", queen "q" and king "k".

The screen 48 displays the ante or the amounts of bets 73, 74 and 75 placed on each card hand 56, 58 and 60, respectively, by the current player, that is player 1 or player 2. The screen 48 also provides hand total indicators 76, 77 and 78 for the corresponding hands 56, 58 and 60 to display the total points earned for a single card hand, as well as game total indicators 71 and 72 for each of the players. The processor 16 indicates the current player by highlighting "PLAYER 1"or "PLAYER 2" in the game total level indicators 71 or 72. The bet amounts entered and the payouts earned by the current player are computed and indicated for the current player, that is, whichever "PLAYER 1" or "PLAYER 2" is highlighted on the game total indicators 71 and 72 at the time. Alternatively, the current player can be indicated on other parts of the screen 48 such as in a screen border or frame 49.

On the initial game screen 48 (FIG. 6), the processor 16 preferably continues to display the cards that were in the card hands 56, 58 and 60 from the previous game, as well as the message "GAME OVER" 79. As will be described in further detail below, the player(s) have a number of buttons on the screen 48 which are activated using a mouse 22 or other point and select type of input device such as a touchscreen. Alternatively, the buttons can be electronic or electromechanical buttons, the outputs of which are connected to the processor 16. The processor 16 is programmed to perform or cease to perform certain functions when a button is activated or deactivated. For example, when a PLAYER button 80 is activated (e.g., either by clicking an area labeled "PLAYER" on the screen 48 with a mouse 22, or touching a corresponding area on a touchscreen), the processor 16 alternately highlights "PLAYER 1" and "PLAYER 2" of the game total indicators 71 and 72 and correspondingly computes amounts of bets and payouts for the highlighted player in accordance with game rules and input signals received from the player using the various buttons on the control panel 14. A SOUND button 82 can be used to selectively engage or disengage a sound generating function of the processor 16 and/or increase and decrease volume. Thus, a player can decide whether or not he or she wishes to play with sound effects or have the game machine remain silent and provide no audio cues or indication of game status. When the DEAL button 84 is depressed, the processor 16 begins to generate images of moving cards, as described in more detail below. The player can then use the mouse 22 or another input device to select and then direct the moving card into a selected card position 62, 64, 66, 68 or 70 of a selected hand 56, 58 or 60. The BET button 86 raises the bet amounts shown on the screen at indicators 73, 74 and 75 in increments of the integer value one each time the BET button is pushed, and correspondingly decreases the game total indicator 71 or 72 for that particular player. The BET_MAX button 88 raises the bet amounts at indicators 73, 74 and 75 to a maximum value as determined by the processor program code (e.g., increment the bet amounts 73, 74 and 75 of each hand 56, 58 and 60, respectively, by five or ten points). The game total indicator 71 or 72 is then correspondingly decreased by the maximum value. The processor can be programmed to generate point totals, cash amounts or other means for indicating amounts earned during game play. For example, cash amounts can be indicated if the game machine 10 is used for gaming applications (e.g., a casino), and point totals can be indicated if the game machine 10 is used for non-gaming applications (e.g., for home entertainment or in pubs, bars, restaurants and the like).

As shown in FIG. 6, the initial game screen 48 provides a player with a SKILL_LEVEL button 90 for setting the desired skill level at which the next game is to be played. The skill level, for example, can be increased incrementally from the least difficult level (e.g., level 1 in a range of levels from 1 to n) to the most difficult level (i.e., level n) and then back decrementally to level 1 each time the SKILL_LEVEL button 90 is activated. The skill levels can be differentiated, for example, by the number of cards dealt at one time, that is, the number of moving cards displayed under processor 16 control as descending simultaneously toward the player hands 56, 58 and 60, or by the rate at which cards descend during the game. If skill level 1 is selected, then only 2 or 3 d is dealt at one time. If skill level 2 or 3 is selected, then two or three cards, respectively, are dealt at one time. The processor 16 can be programmed to alter the payout table 52 in accordance with skill level, that is, the winnings for a particular poker hand can be graduated for card games played at each of the skill levels.

With reference to blocks 102 and 104 in FIG. 3, a player can begin a new game such as electronic poker by selecting the skill level at which to play the next poker game using the skill level button 90. As indicated by blocks 106 and 108, the player can then depress the BET button 86 or BET_MAX button 88 to place a wager, and the DEAL button 84 to request that cards be dealt. The manner in which a wager is placed and cards are dealt is described below in connection with FIGS. 4 and 5, respectively. After all the cards for a game involving the card hands 56, 58 and 60 have been dealt, and placed into a card hand by either the player or automatically by the processor 16, the processor 16 computes the point value or the monetary value of each of the card hands 56, 58 and 60 and displays the values via the indicators 74, 75 and 76, as shown in blocks 110, 112 and 114. A second player can, at this point, can depress the player button 80 to play three new cards hands 56, 58 and 60 by placing a wager and requesting that cards be dealt, as indicated by the affirmative branch of the decision block 116. The point or monetary value of each of the hands 56, 58 and 60, after all cards have been dealt and placed by either the second player or the processor 16, is then computed by the processor 16 and displayed at the indicators 73, 74 and 75. The first and second players can view the indicators 71 and 72 on the display 12 to determine who is winning the game overall.

Figure 4:
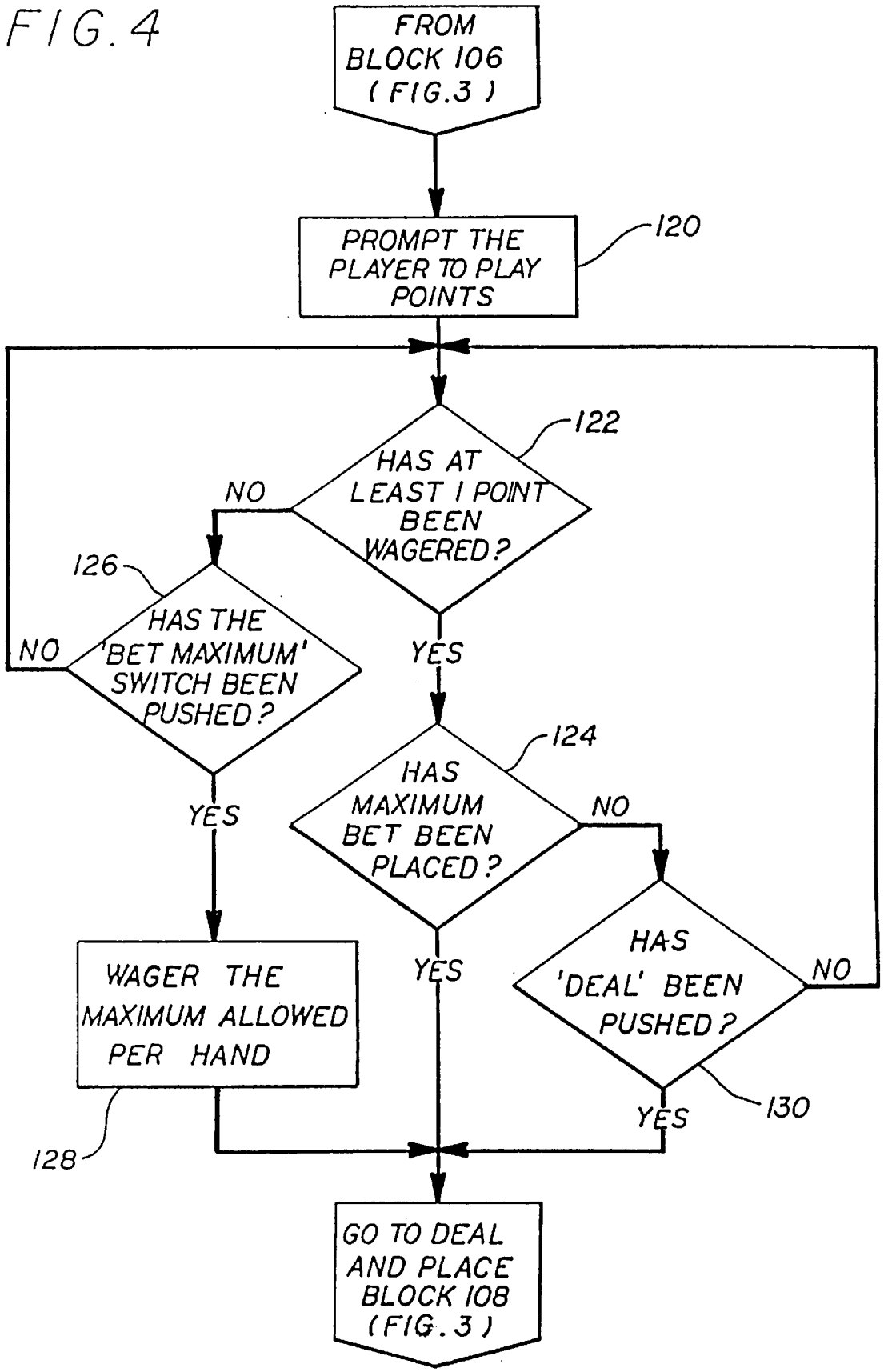

With reference to block 120 of FIG. 4, the processor 16 is programmed to prompt the player(s) to depress either the BET button 86 or the BET_MAX button 88 a selected number of times to incrementally increase the point or monetary values shown by the indicators 73, 74 and 75. If the game machine 10 is used in a gaming application, the player can deposit money in the bill and coin acceptor 28. The processor 16 then determines from the output of the bill and coin acceptor 28 a monetary amount to display using indicator 71 or 72, depending on which player is depositing the money and which of the indicators 71 and 72 is currently highlighted, as described above in connection with screen 48. The players can be restricted by the processor 16 to limit initial wagers to amounts less than or equal to the initial value displayed by indicators 71 and 72. In a non-gaming application, the processor 16 can be programmed to allow players to place initial wagers without reference to money being deposited in the game machine 10. For example, the processor can be programmed to initially grant each player an initial game total (e.g., 10 points) that is predetermined by program code and displayed using the indicators 71 and 72. A player can, however, be required to deposit a predetermined, nominal amount of money (e.g., a quarter) into the coin and bill acceptor 28 for each game, even in a non-gaming application. Thus, a commercial establishment such as a video arcade may recoup the cost of acquiring a game machine 10 for use by customers and possibly earn a profit.

As indicated by block 122, the processor 16 monitors the input signals from the mouse 22 or other input device to determine whether a player has entered a wager amount in at least one of the hands 56, 58 and 60. If the maximum wager amount permitted by the program code of the processor 16 has been entered by the player, as indicated by the affirmative branches of blocks 124 and 126 and by block 128, the processor 16 is programmed to deal cards once the user activates the DEAL button 84. The player is otherwise permitted to increase the wager amount shown by the indicators 73, 74 and 75 by the integer value one (i.e., by one point or one dollar) each time the BET button 86 is depressed, as indicated by the negative branches of decision blocks 126 and 130. Alternatively, sets of BET buttons or a HAND button (not shown) can be provided, or the mouse 22 or other input device can be used to point to and select one of the indicators 73, 74 and 75, to enter different wager amounts for the respective card hands 56, 58 and 60. After a wager amount is entered, the processor 16 debits the corresponding amount from the game total amount displayed by the indicator 71 or 72 assigned to that particular player.

Figure 5:
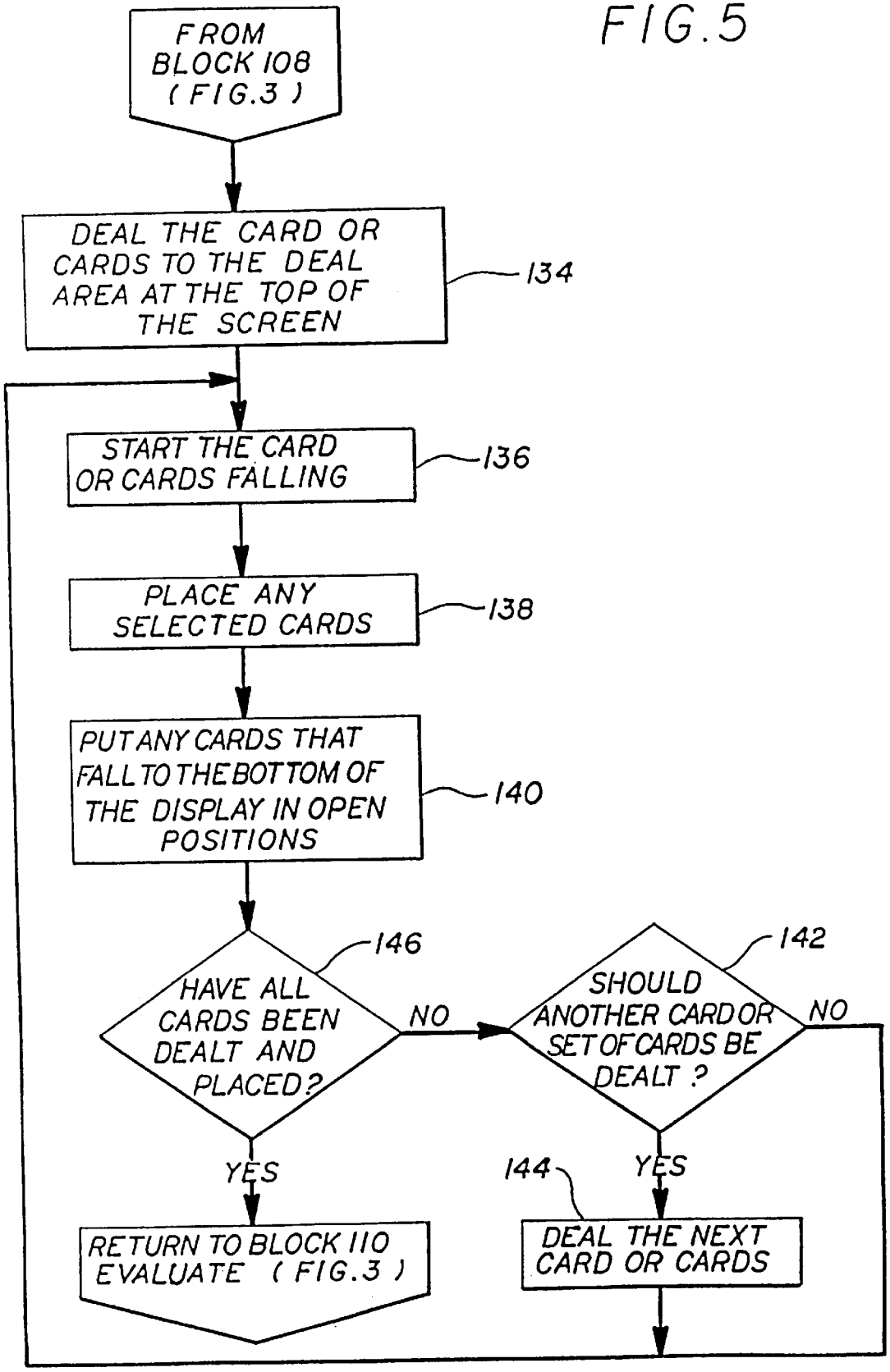
Figure 7:
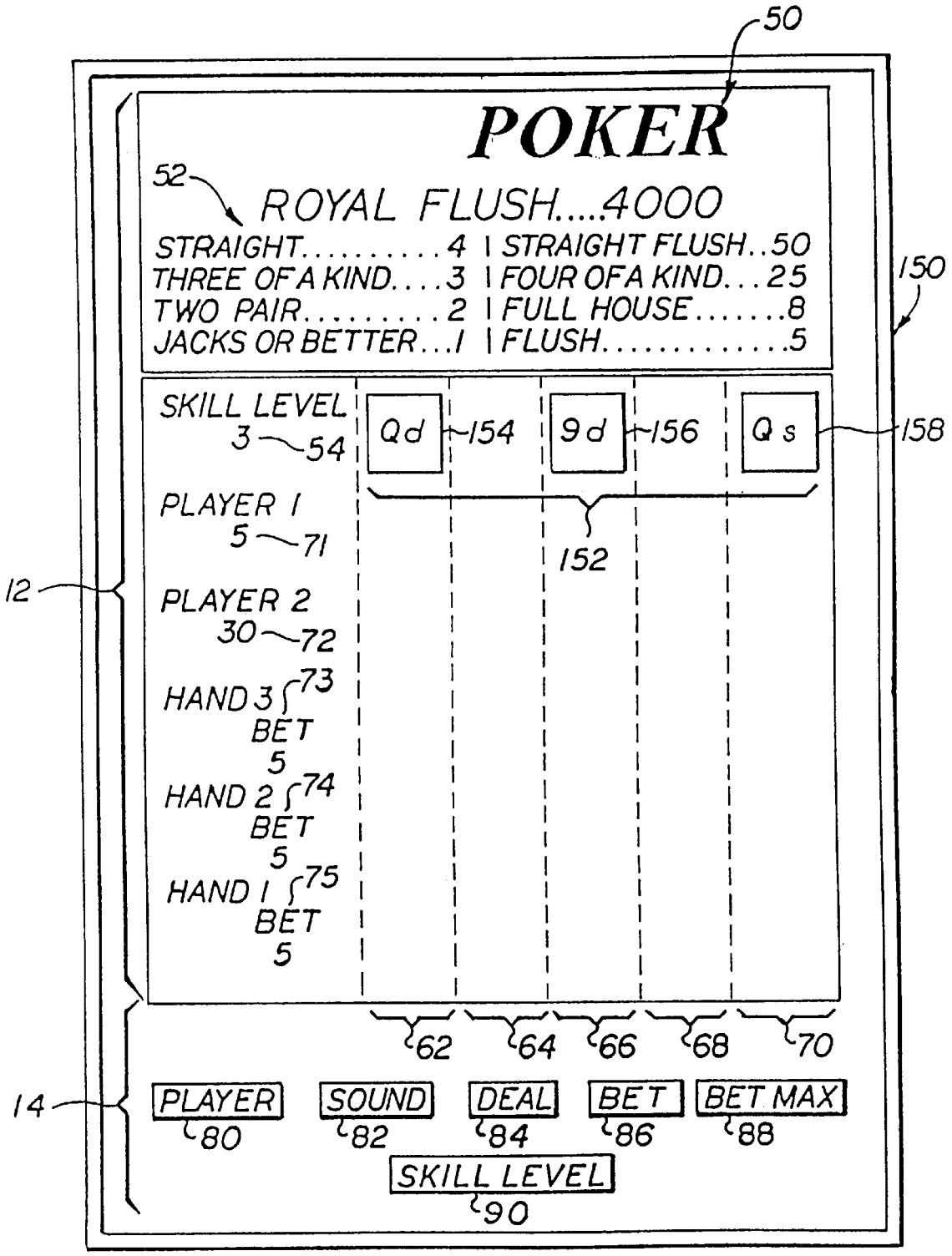

After the player depresses the DEAL button 84, the processor 16 generates an image of one or more cards 154, 156 and 158 preferably at the top of the screen 150 in FIG. 7, as indicated by block 134 in FIG. 5. The dealt cards 154, 156 and 158, as well as corresponding cards on the screens in FIGS. 7–22, shall be indicated generally by reference numeral 152. The dealt cards 152 move toward the card hands 56, 58 and 60 at the bottom of the display device 12 either immediately or after a relatively brief pause following activation of the DEAL button 84, as indicated in block 136. It is to be understood, however, that the position of the moving cards 152 relative to the card hands 56, 58 and 60 on the display device 12 need not be vertical. The hands 56, 58 and 60 and the dealt cards 152 preferably need only to be separated from one another such that the dealt cards 152 travel a specified distance on the display device 12 along a path (e.g., toward the card hands 56, 58 and 60). The card hands 56 and 60 are not required to be adjacent to one another. For example, they can appear on opposite sides of the display device 12. Further, the dealt cards 152 need not move from the top to the bottom of the display device 12, that is, they can move upwardly, diagonally, transversely from left to right, transversely from right to left, and so on, on the display device 12.

With continued reference to FIG. 5, the processor 16 is preferably programmed to deal one, two or three cards at one time to play five card poker, for example, depending on the skill level selected by the player (block 104 of FIG. 3). It is to be understood that the processor 16 can be programmed to play other types of poker, such as six-card poker. The processor preferably generates images of these dealt cards 152 falling in columns from the top of the display device 12 toward the card hands 56, 58 and 60 at the bottom thereof. For a game machine 10 configured to play five card poker, five columns are used, as indicated by the phantom lines in FIG. 7, which correspond to the five card positions 62, 64, 66, 68 and 70 in FIG. 6 and are therefore given the same reference numerals as the card positions. Thus, for a card game involving three hands 56, 58 and 60, the processor 16 is programmed to deal fifteen cards, three of the fifteen cards being dealt in each of the five columns 62, 64, 66, 68 and 70.

In the illustrated embodiment, three cards indicated generally at 152 are dealt at one time, as shown in FIGS. 6–20. The processor 16 can be programmed to allow a player to select each of the three falling cards 152 and direct its placement into one of the card positions or columns 62, 64, 66, 68 or 70 of one of the hands 56, 58 or 60, as indicated in block 138 of FIG. 5.

Figure 8:
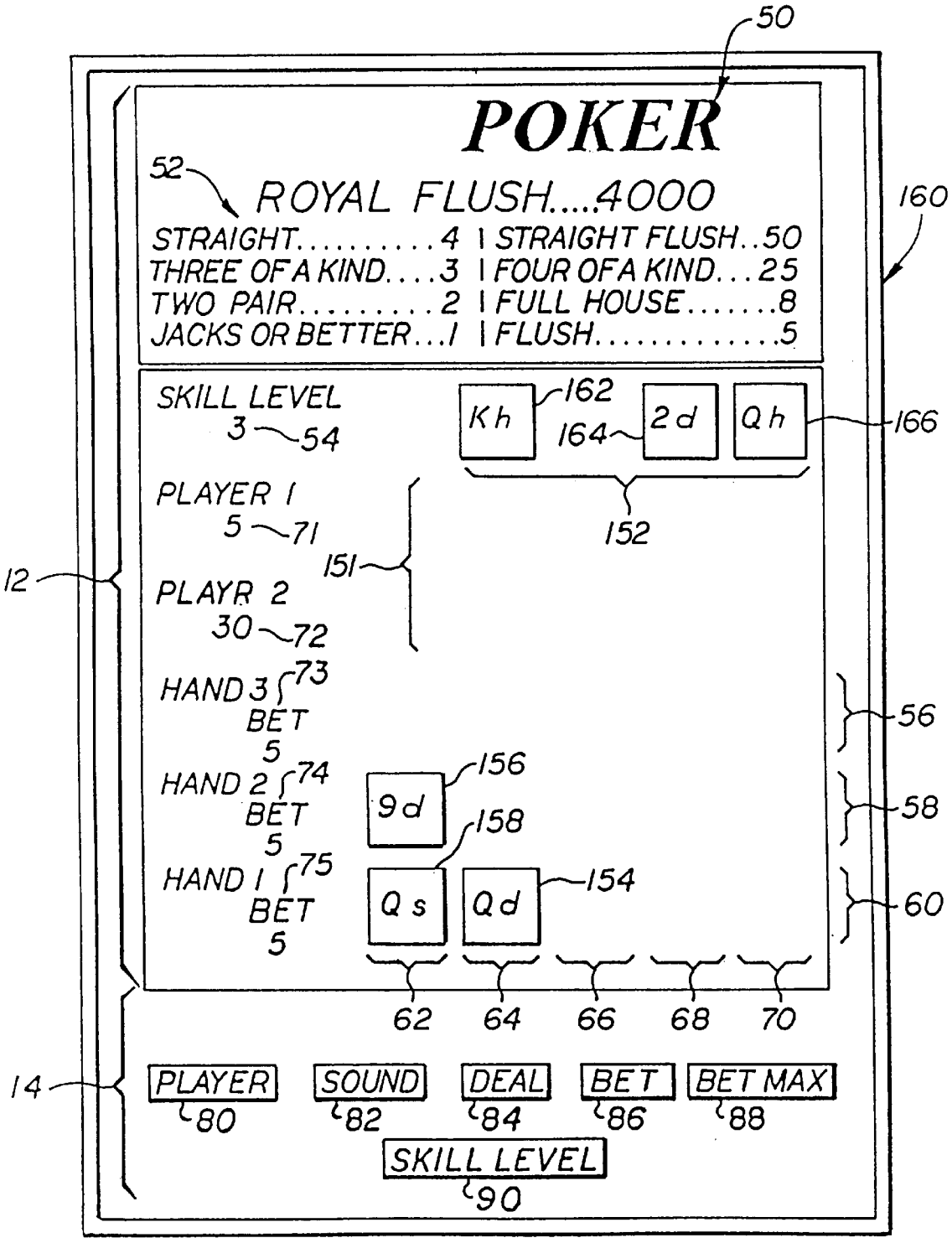

Alternatively, the initial card deal can send dealt cards 152 to the hands 56, 58 and 60 automatically and not allow for player input as to placement of the cards. A player selects one of the falling cards 152 by pointing at the card with a point and select input device such as a mouse 22, a light pen or placement of the player's finger on a touchscreen 30. For example, the player can move a screen cursor to the selected falling card using the mouse 22 and click the mouse. The player can then use the point and select device to direct the placement of the selected card to one of the card positions 62, 64, 66, 68 or 70 in one of the hands 56, 58 or 60. The card can be directed to a column other than the column from which it originated. Further, the three initially dealt cards 152 need not originate from the same columns for each deal, as illustrated in FIGS. 7 and 8. The dealt cards 152 in FIG. 7 originate from columns 62, 66 and 70, whereas the dealt cards 152 in FIG. 8 originate from columns 64, 68 and 70. If the player reacts quickly, the player can do the same point, select and direct operations on the other two of the three dealt cards 152 and place them as desired before they fall to the bottom of the display device 12 and are placed in card positions automatically by the processor 16.

With reference to block 140 in FIG. 5, the processor 16 can place the cards that are not directed to card positions selected by the player in the same column from which they originated, or randomly place the unselected falling cards into any of the fifteen card positions that are not already filled. The processor 16 is preferably programmed to place the unselected, fallen cards in unfilled positions of the hand 60 closest to the bottom of the display device 12 first, and then in unfilled positions in the next hand 58 when the hand 60 is full. Similarly, unselected, fallen cards are automatically placed by the processor 16 in unfilled card positions of the hand 56 when all card positions in the hand 58 are filled. The processor 16 preferably fills the card positions in a hand from the card position 62 on the left side of the display device 12 toward the card position 70 on the right side of the display device 12.

As will be described in further detail below, the screens in FIGS. 6–20 depict cards which have been directed to card positions 62, 64, 66, 68 and 70 by the player using a point and select input device such as a mouse, or placed automatically in card positions by the processor 16 in accordance with program code. The dealt cards 154, 156 and 158 in FIG. 7 are shown as having been successfully directed to selected card positions by the player, as opposed to being automatically placed in a card position by the processor 16. For example, the player placed cards 158 and 154 in the first hand to create at least a two pair for two points. The player directed card 156 to the second hand. If the player had not reacted in time to select and direct the card 156 before it reached the bottom of the display device 12, that is, before it reached the card position 62, 64, 66, 68 and 70 of hand three, the processor 16 would have automatically placed the card 156 in card position 66 of hand one.

When a card is selected, processor 16 can generate a sound and/or highlight or flash the card on the display device 12. If a second card is selected before the first card is placed in a card position, the processor can be programmed to generate a sound, cease highlighting or flashing the first card, and commence highlighting and flashing the second card.

With reference to blocks 142, 144 and 146 of FIG. 5, the processor 16 is programmed to deal the next card or cards (e.g., the three cards 162, 164 and 166 shown in FIG. 8 of the exemplary poker game depicted in FIGS. 6–20). The player is once again successful at directing the placement of all three cards before any one of the three cards reaches the bottom of the playing field which is denoted by reference numeral 151 in the screen 160 depicted in FIG. 8. If the player uses a touchscreen controller 32, the player can drag the card, that is, the processor 16 and the video controller 34 can generate a moving card image which follows the player's finger as the player sweeps his finger across the touchscreen 30 to a selected, final card position. Alternatively, the player can touch a card on the display 12 in order to select the card and then remove his finger from the card and touch an open card position in one of the three hands 56, 58 or 60. The processor 16 is programmed to remove the card image from the top of the screen 160 and regenerate the card image in the selected open card position. The processor 16 can also generate an image of the selected card sliding from its original position toward the selected open position. If the processor 16 deals only one card at a time, as opposed to two or three cards at one time, the player can touch a selected open position in a card hand and the processor 16 automatically moves the card to that position. If another point and select device is used besides a touchscreen 30, the player can move the pointer to the card he or she wishes to select using a mouse 22 or light pen, for example, and selects the card (e.g., by clicking the mouse 22 or light pen). The player can then move the mouse 22 or light pen to a selected open card position and select that card position. The processor 16 subsequently removes the card from its original position and regenerates an image of the card in the selected open position, or slides the card image to the selected open position in full view of the player.

The processor 16 can suspend dealing the next card or set of cards until all of the dealt cards 152 have been placed, either by the player or automatically by the processor 16. If the game machine 10 is configured to deal two cards at one time, both cards would therefore need to be placed before the next two cards are dealt. Alternatively, the processor 16 can be programmed to deal a card as soon as a previous card is placed. Thus, if the game machine 10 is configured to deal two cards at one time, the processor 16 deals a new card each time the previous card is placed into one of the three hands 56, 58 or 60 such that two cards are selectable at any one time. These two options are also available for a game involving more than two cards.

Figure 9:
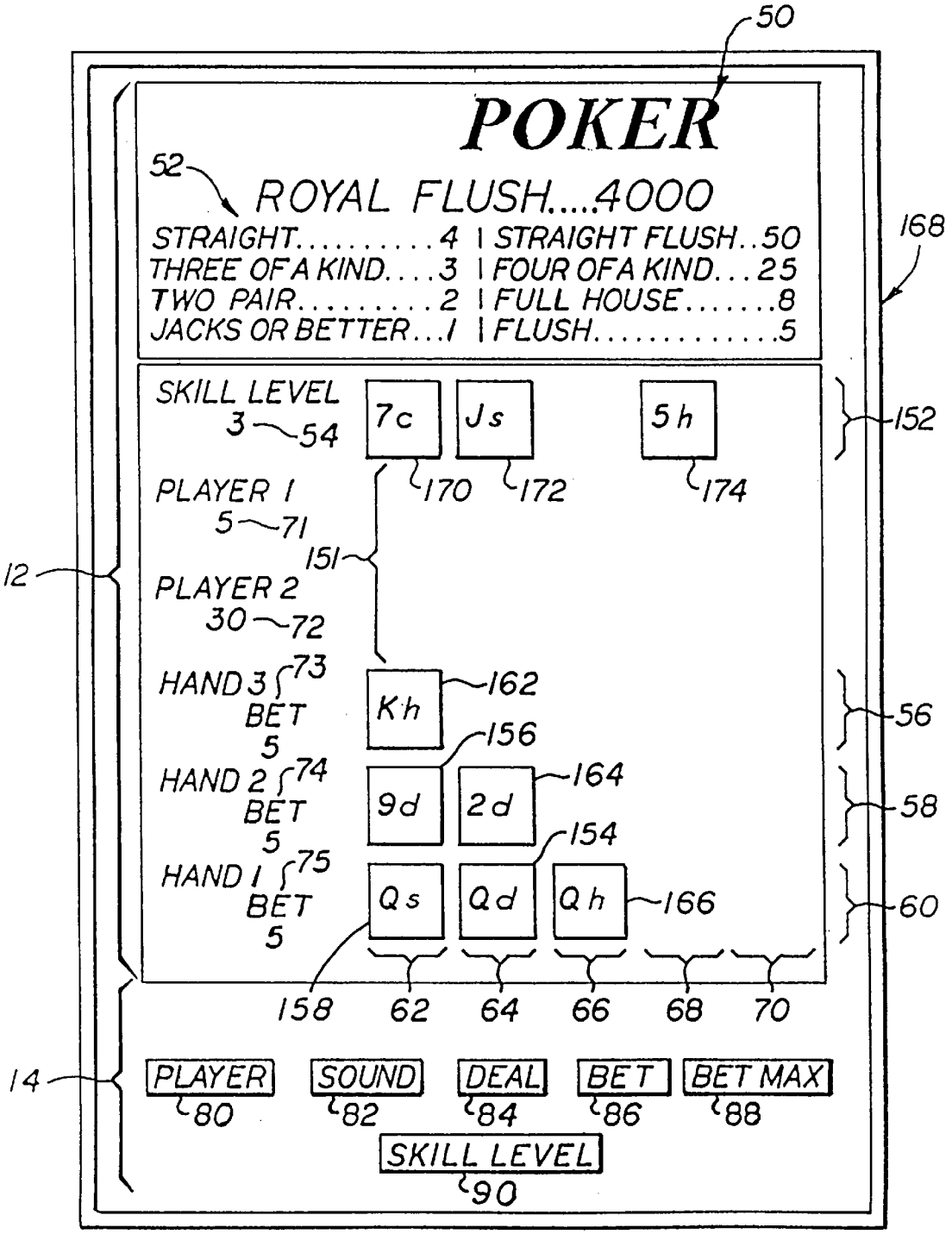
Figure 10:
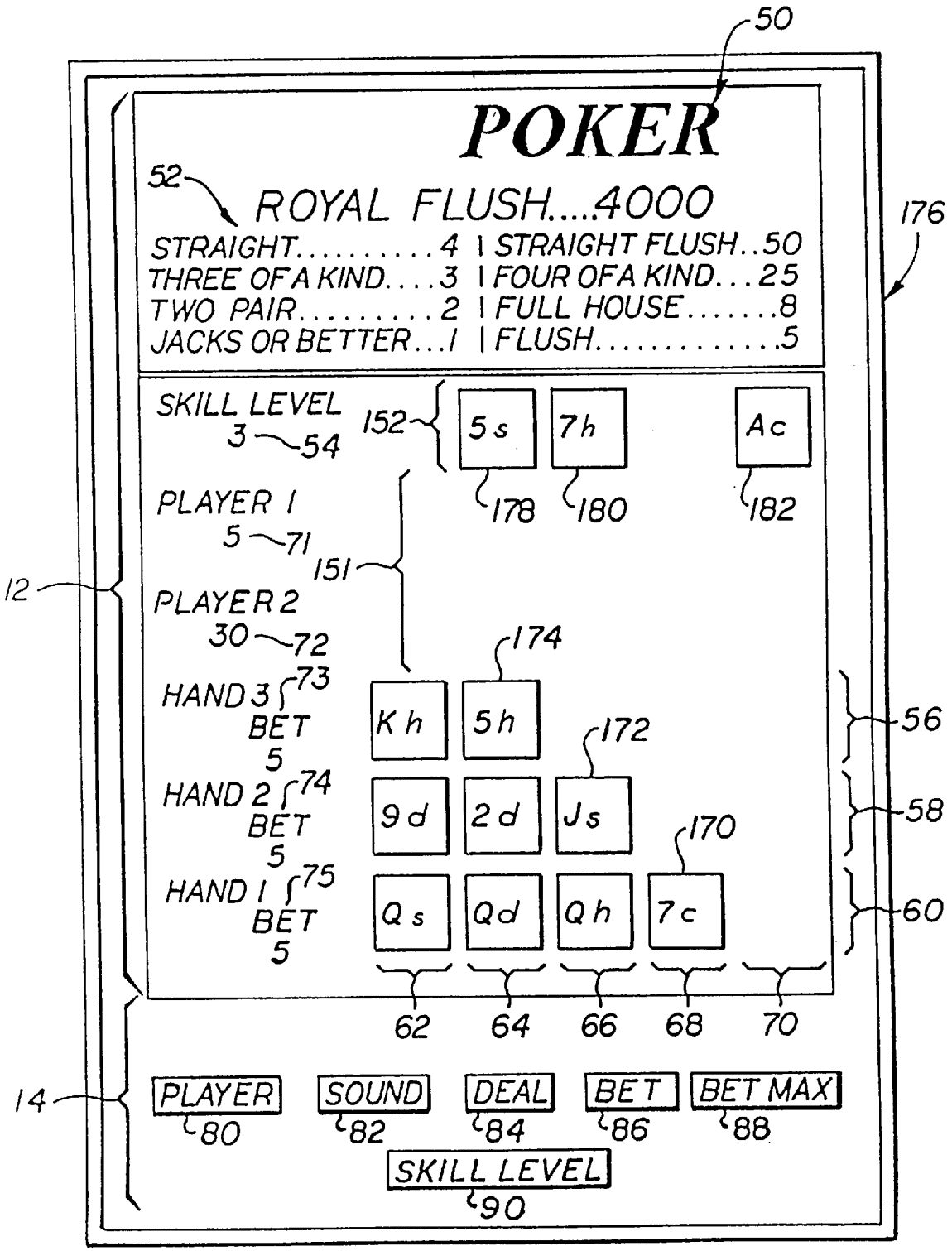

With reference once again to blocks 136, 138 and 140 of Fig. 5 and to FIG. 9, the card 166 was placed in the first hand to create a three-of-a-kind poker hand. The card 164 was placed in the second hand to create a flush poker hand. The card 162 was placed in the third hand by the player. The processor 16, therefore, did not have to automatically place any one of the falling cards 152 in FIG. 8. As indicated in blocks 142, 144 and 146 of FIG. 5, another set of cards 152 (i.e., the cards 170, 172 and 174) is dealt by the processor 16, as shown in FIG. 9. The cards 170, 172 and 174 commence falling, as indicated in block 136 of FIG. 5. As shown in FIG. 10, the player placed the card 174 in the hand 56 to create at least a flush poker hand. The player placed the card 172 in the hand 58 to create potentially a two-pair or three-of-a-kind poker hand. FIG. 10 illustrates the placement of a card 170 automatically by the processor 16 into the bottom-most hand having an unfilled card position, such as card position 68 of the hand 60. Alternatively, the card 170 can be placed in unfilled positions of card hands (e.g., position 66 of hand three). The screen 176 in FIG. 10 also illustrates another set of dealt cards 152 comprising cards 178, 180 and 182 in accordance with blocks 142, 144 and 146 of FIG. 5.

Figure 11:
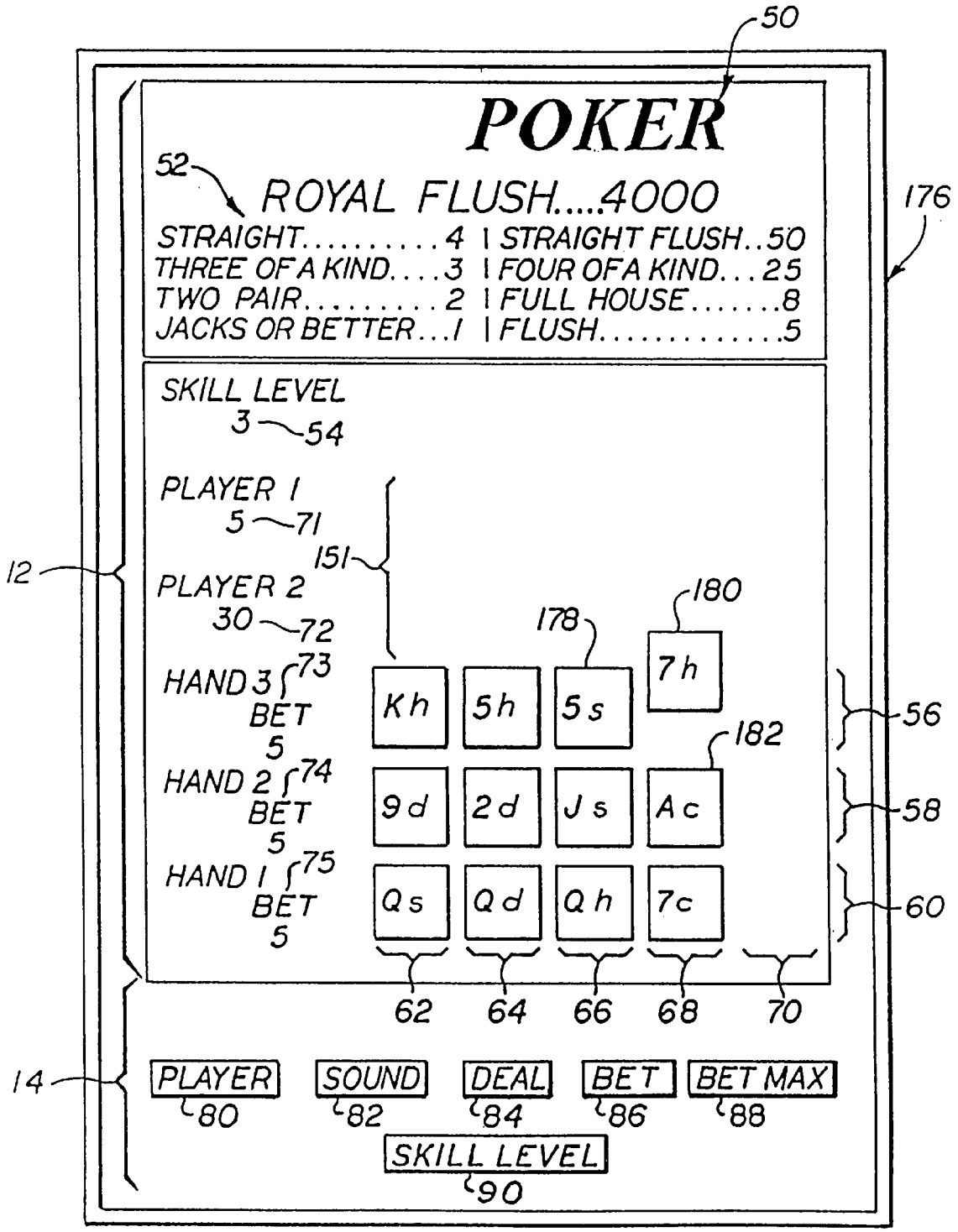
Figure 12:
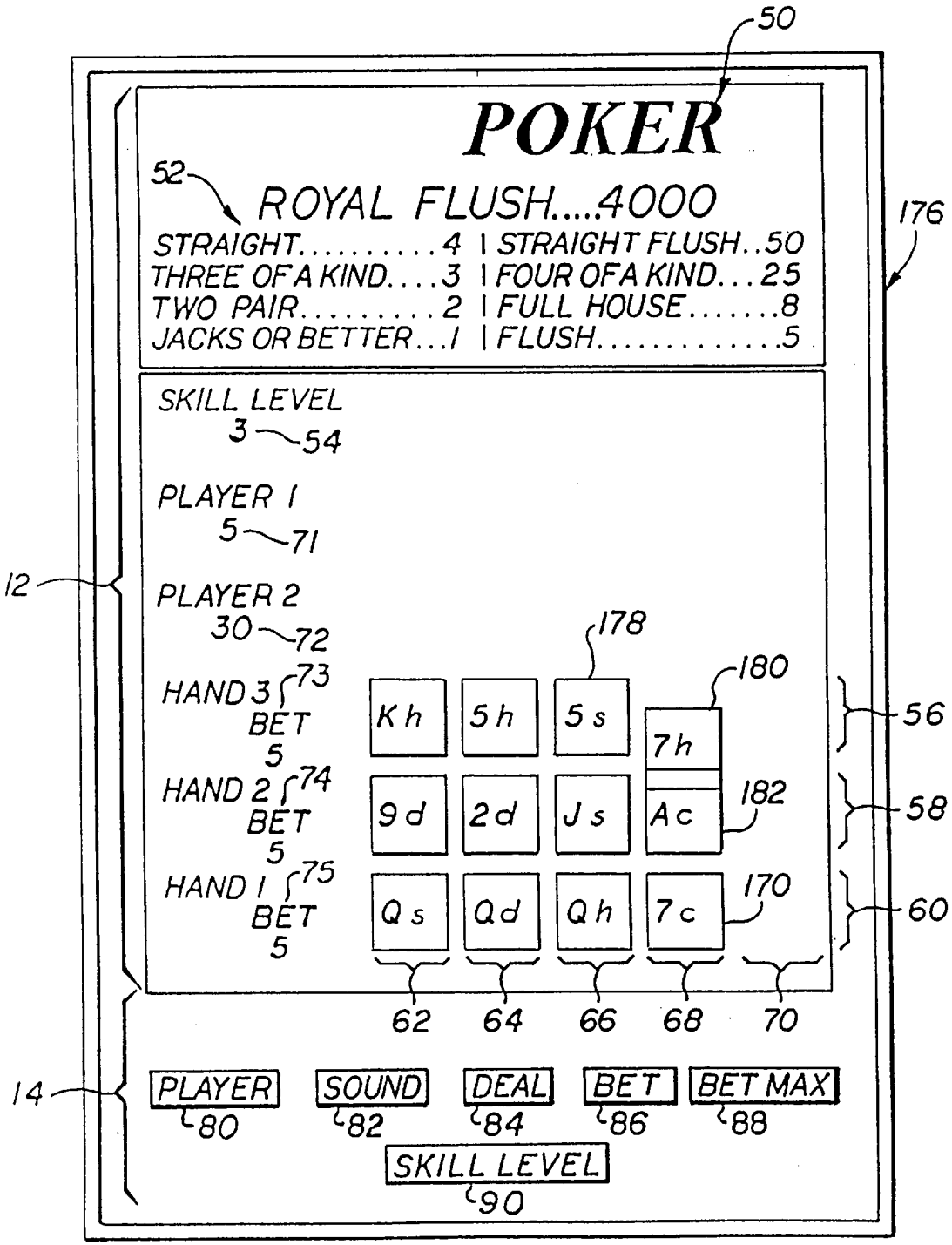
Figure 13:
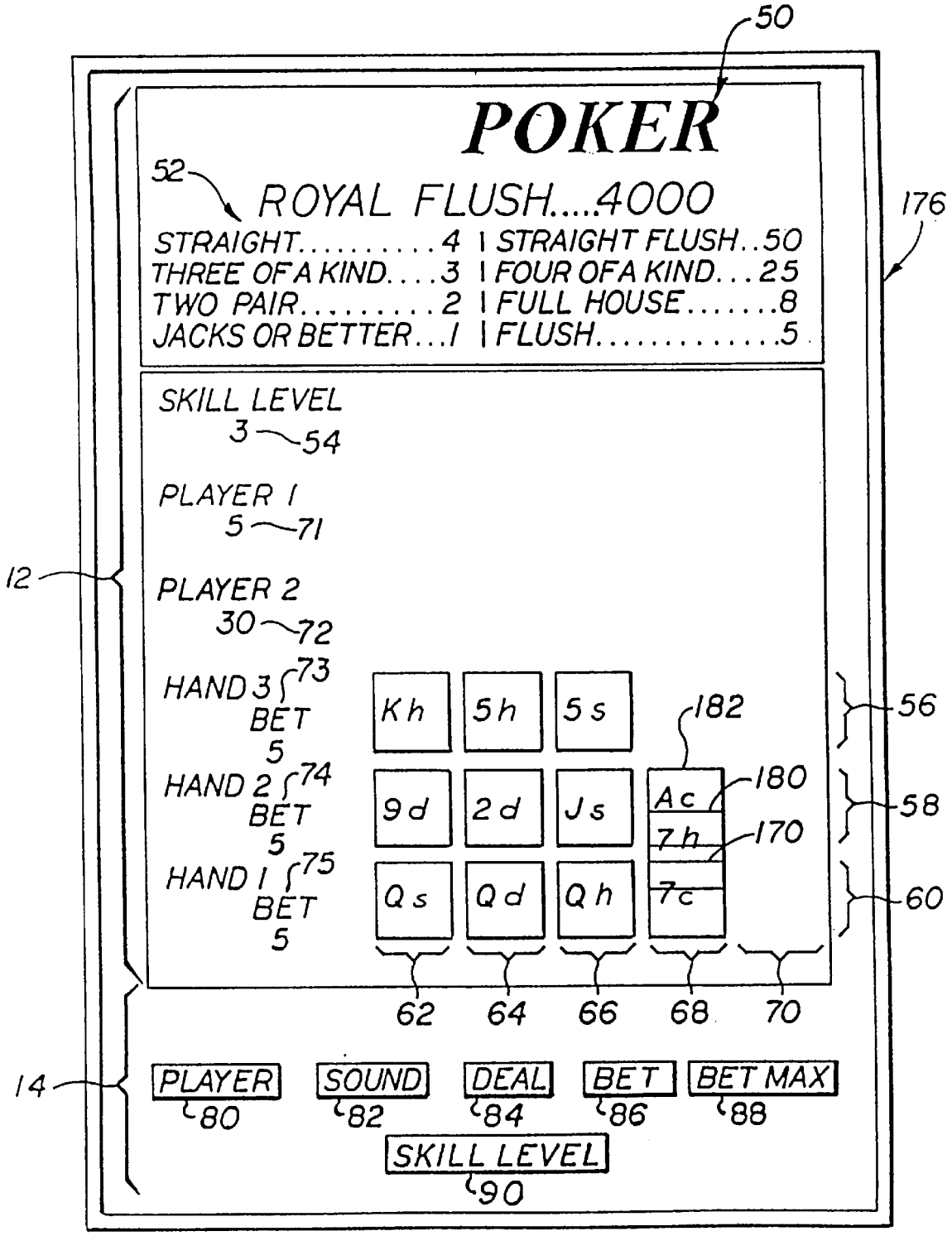
Figure 14:
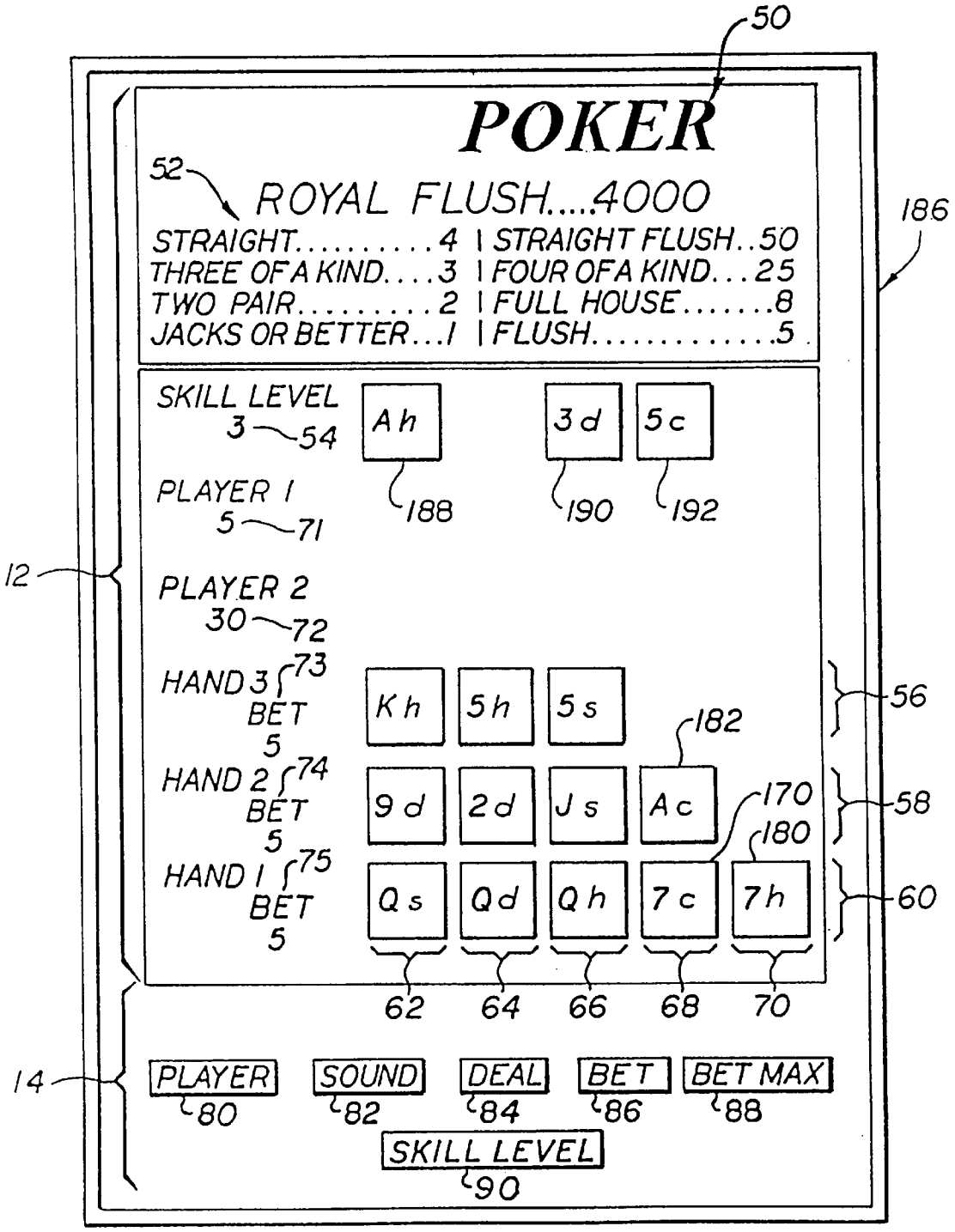
Figure 15:
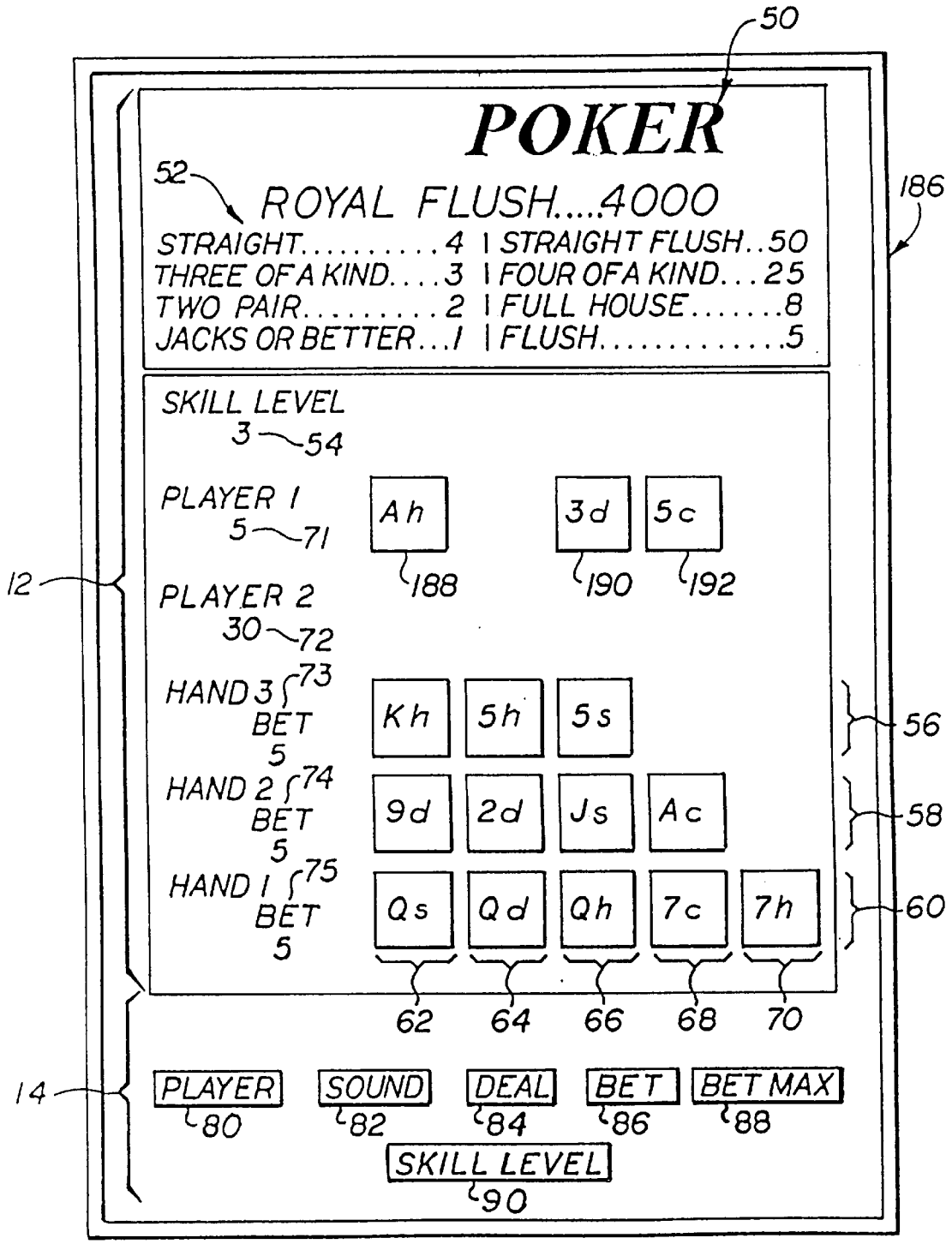
Figure 16:
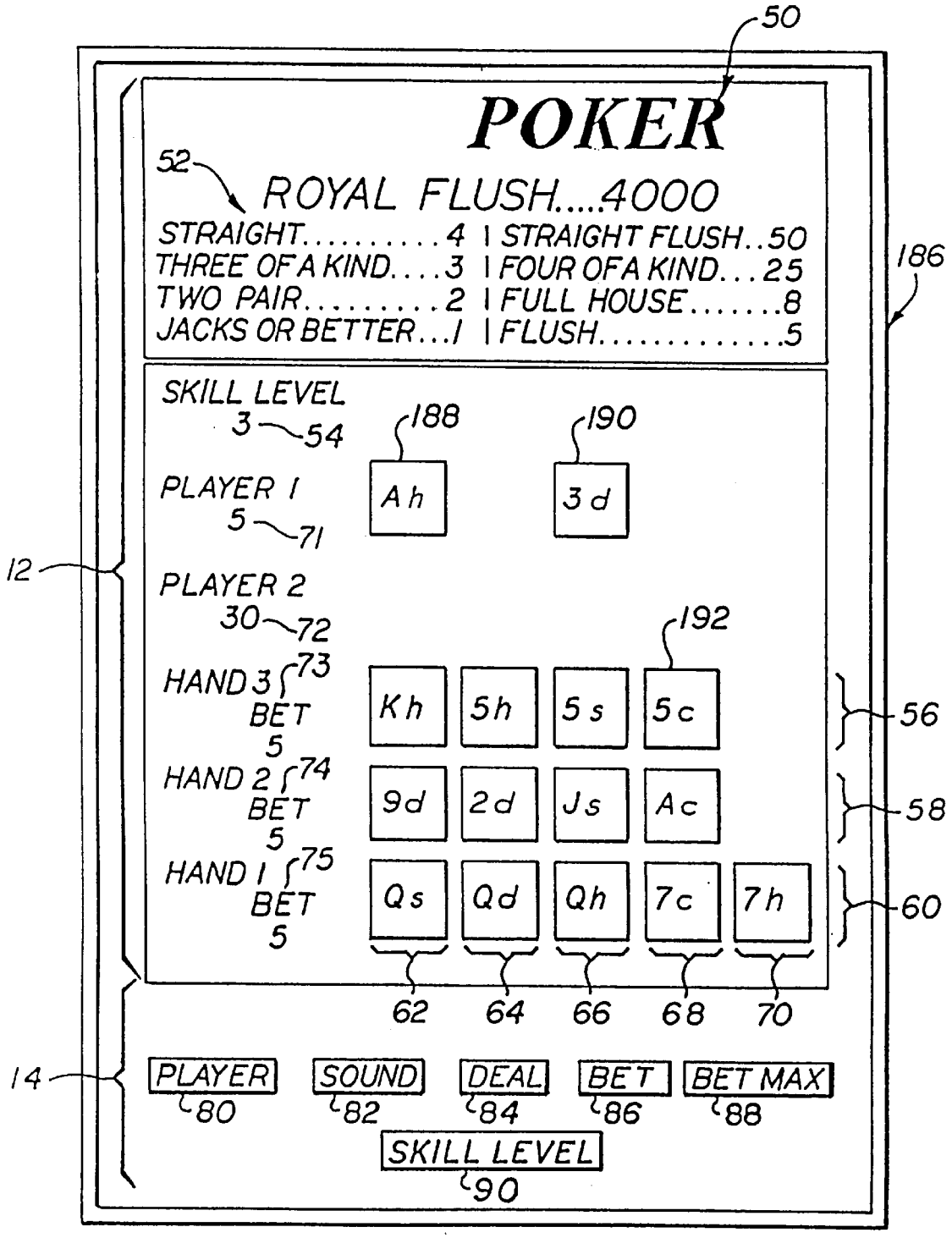
Figure 17:
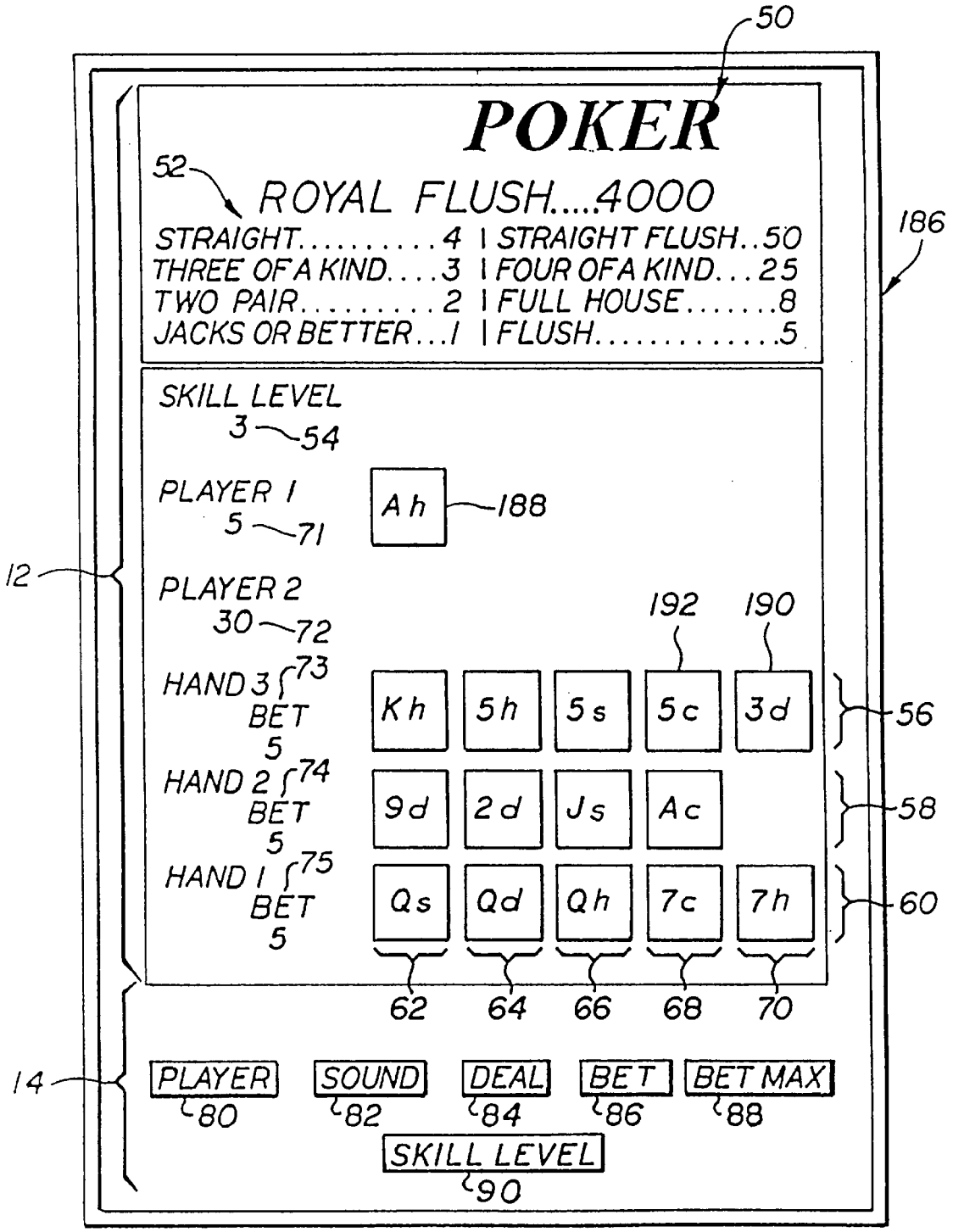
Figure 18:
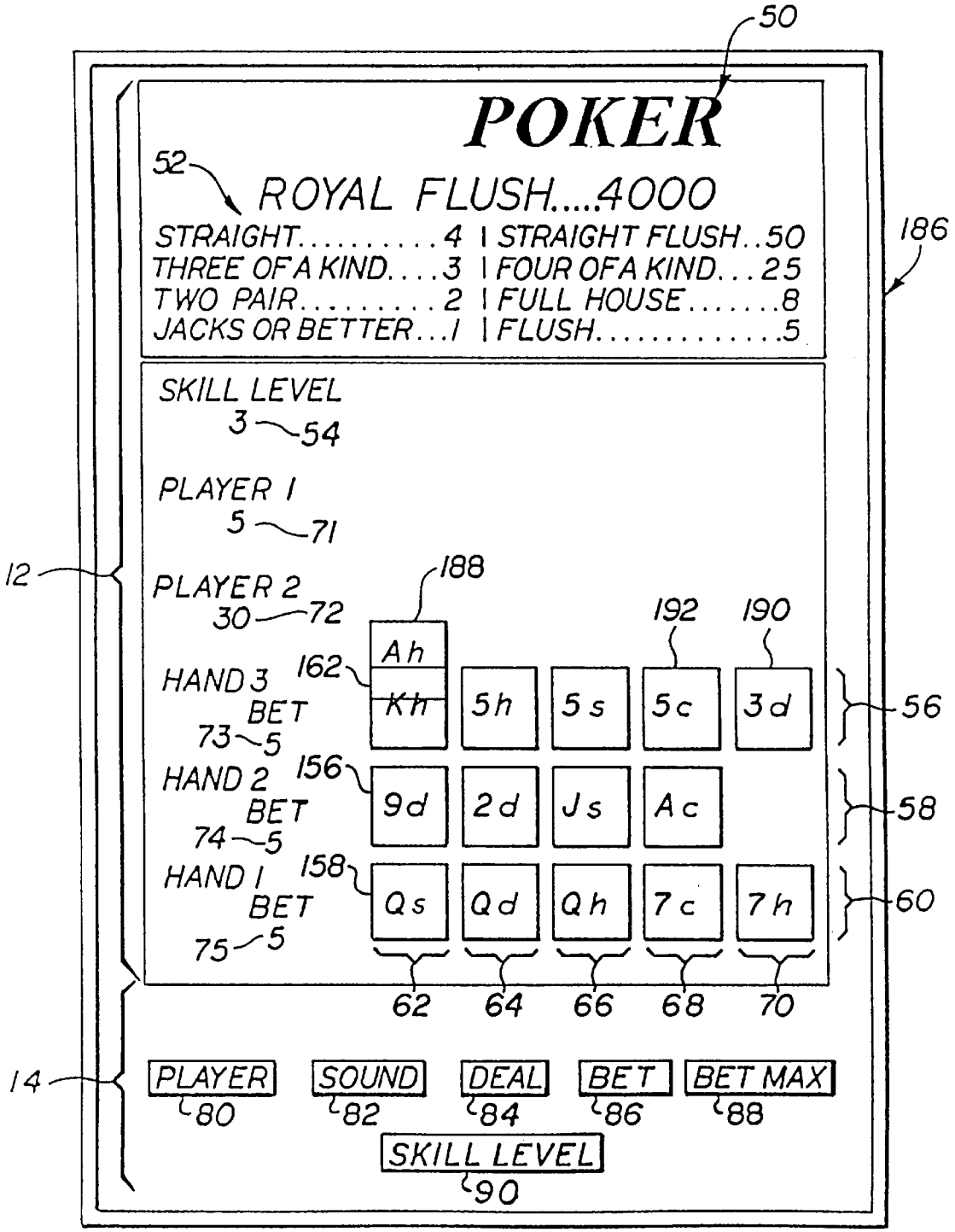
Figure 19:
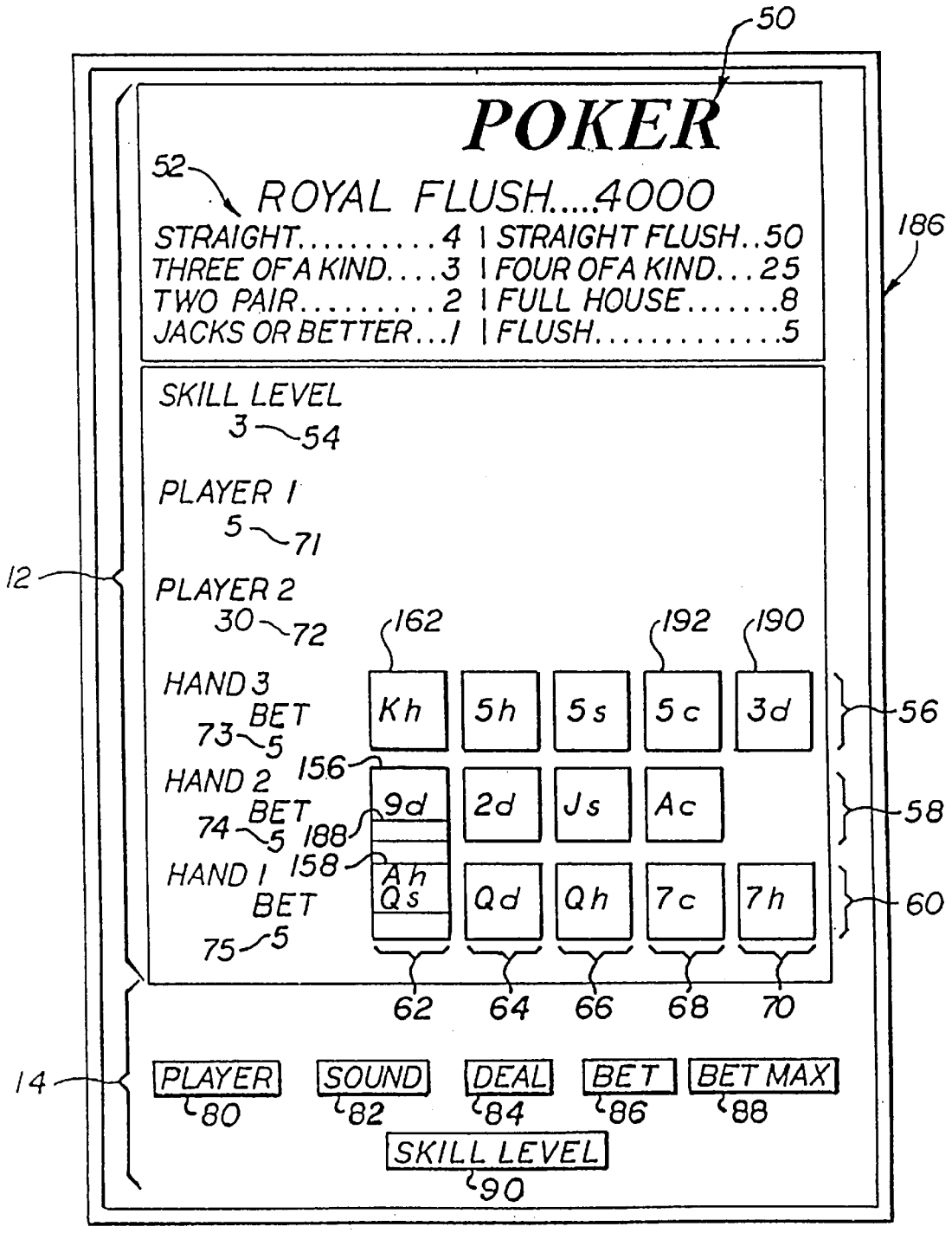
Figure 20:
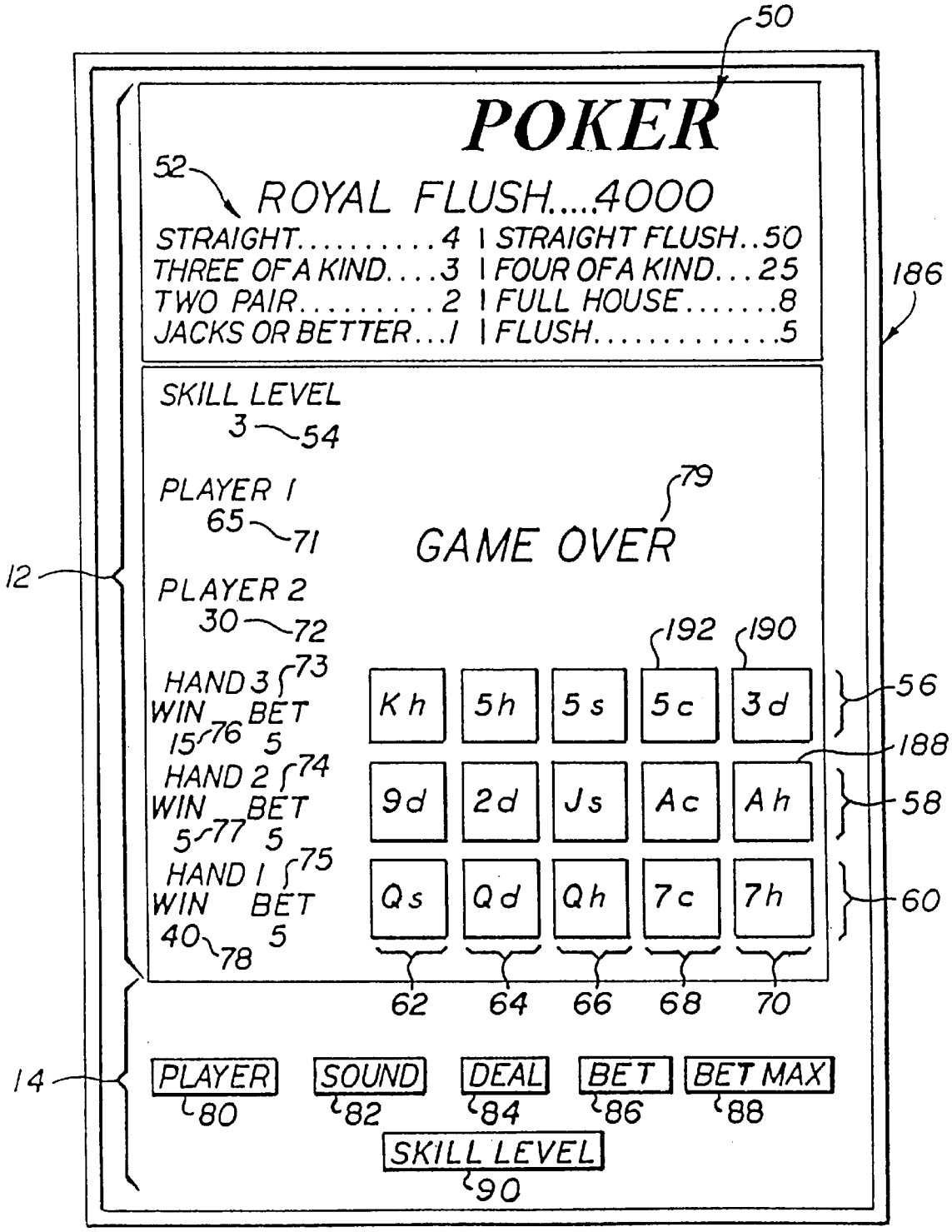

With reference again to blocks 136, 138 and 140 in FIG. 5 and as shown in FIG. 11, the user selects and directs the cards 178 and 182 to card positions 66 and 68 of the hands 56 and 58 respectively. FIGS. 12 and 13 illustrate the manner in which the card 180 falls toward the bottom of the display device 12 and continues moving within its column corresponding to card position 68 because it has not been selected by the player. As shown in FIG. 14, the processor 16 automatically places the card 180 in an unfilled card position of the lowest hand containing unfilled card positions, i.e., hand 60. The screen 186 in FIG. 14 also illustrates the last set of cards 152 (i.e., cads 188, 190 and 192) dealt by the processor 16. FIGS. 14–17 illustrate the manner in which selected cards 190 and 192 in screen 186 are dragged across the display 12 by the processor 16 in accordance with input signals from a point and select device operated by the player to a card position in a card hand selected by the player. FIGS. 18, 19 and 20 illustrate the manner in which an unselected card 188 in screen 186 descends towards the bottom of the display device 12 and is automatically placed in an unfilled card position of a card hand 58 by the processor 16.

As indicated in the affirmative branch of block 146 in FIG. 5, the processor 16 is programmed to evaluate the three card hands 56, 58 and 60 to determine a point or monetary value in accordance with the payout schedule 52 and the selected skill level 54, as shown in block 110 of FIG. 3. The point or monetary value earned for each hand 56, 58 or 60 is provided by the processor 16 on the display device 12 at the corresponding indicator 76, 77 and 78, as indicated in blocks 112 and 114 of FIG. 3. The processor 16 subsequently awaits the activation of the PLAYER button 80 before accepting a wager from a second player, as indicated by the affirmative branch of decision block 116 and block 106. The second player proceeds to play a similar game wherein fifteen cards are dealt by the processor 16 to the three hands 56, 58 and 60, each containing five cards, as indicated by blocks 108, 110 and 112. The point or monetary value for the second player is computed by the processor 16 and shown by indicator 72, as indicated by block 114 of FIG. 3. After the second game is over, a new game can be played at a different skill level if desired, as indicated by the affirmative branch of decision block 118.

Figure 21:
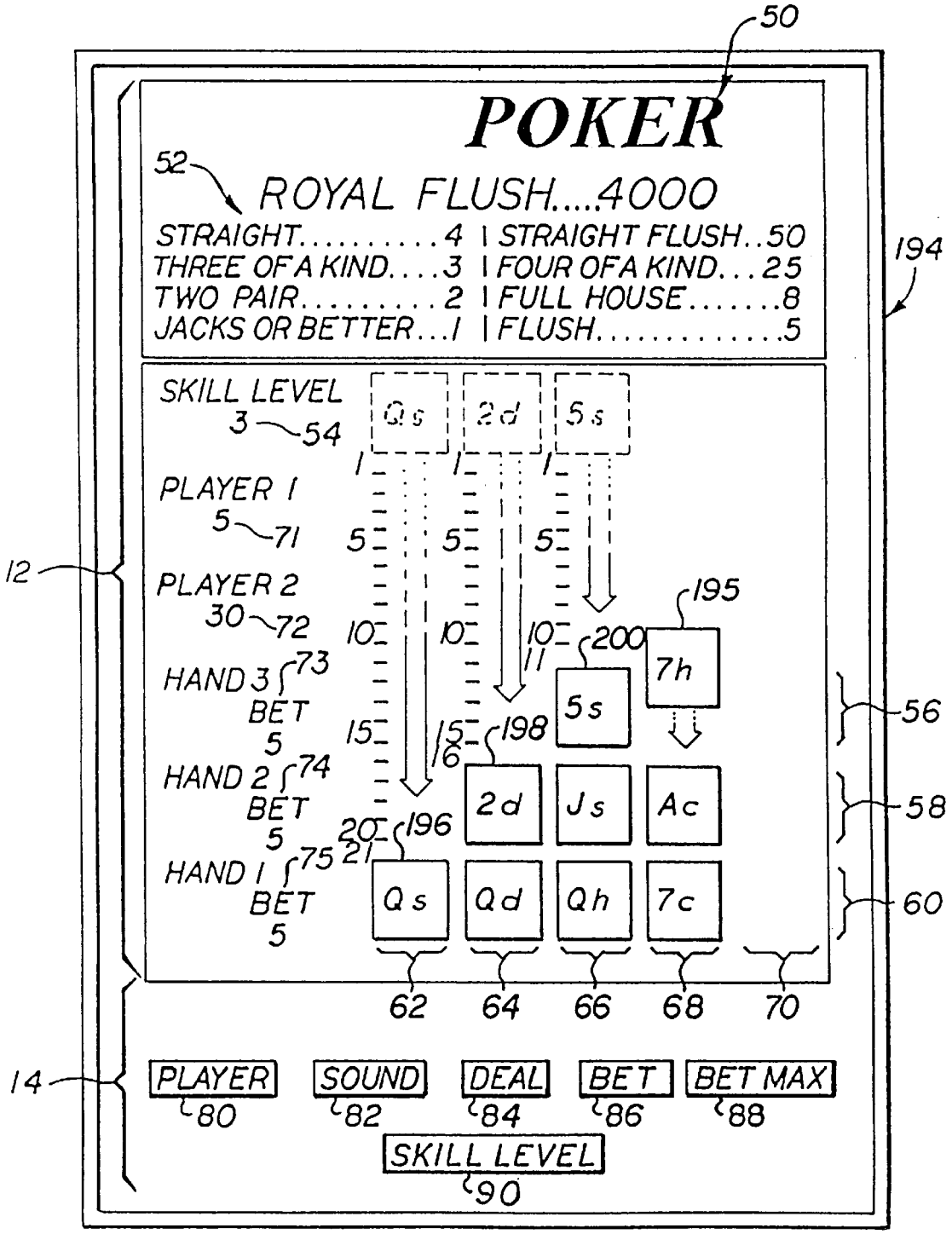

The processor 16 can create the image of a moving card which descends towards the bottom of the display device 12 in steps preferably dimensioned to be one-fourth the size of a card. For example, a card descends 21 steps to the hand 60, 16 steps to the hand 58, and 11 steps to the hand 56, as indicated by cards 196, 198 and 200 in FIG. 21, for a total of 48 steps. The screen 194 in FIG. 21 represents one of several screens generated by the processor 16 during a poker game in which one card (i.e., card 195) is dealt at one time. The cards 196, 198 and 200 were dealt on previous screens and hence are shown in phantom at the top of the screen 194. The processor 16 can be programmed to move each card preferably at a rate of 115 milliseconds per step. In a game where three cards are dealt at one time, there preferably exists an average of 48 steps per three cards or 16 steps per card. If 115 milliseconds are required per step and 16 steps are required per deal, then a card requires an average of approximately 1.84 seconds to descend to a card position once dealt by the processor 16.

Figure 22:
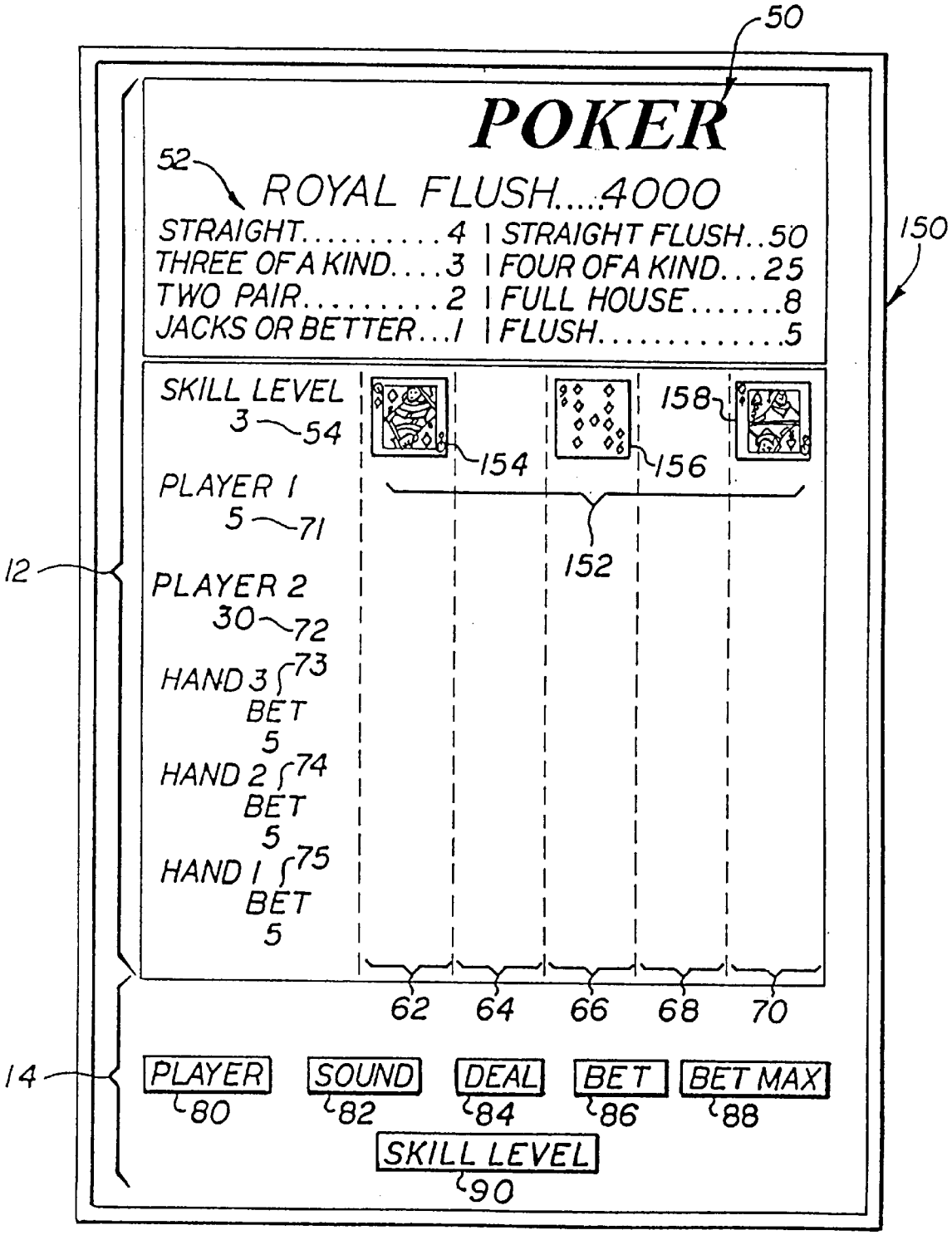

The indicia used on the cards can vary in accordance with different embodiments of the present invention. For example, alphanumeric indicia can be used to indicate the suit and value of each card, as described above and shown in FIGS. 6–20. Alternatively, the processor 16 can generate images of cards which resemble conventional game cards as shown in FIG. 22. Depending on the graphic capability of the game machine 10, a processor which generates graphic images of playing cards as shown in FIG. 22 may be limited to the number of hands that can be shown on the display 12 at one time.

The pay table 52 shown at the top of each of the screens in FIGS. 6–20 can be determined by computer simulations and stored in the memory of the processor 16. Computer programs can be created to simulate different numbers of dealt cards 152 and playing strategies. The simulations can be used to determine the best pay table for each number of dealt cards 152 (i.e., one, two or three cards dealt at one time). A computerized simulation can assume no player interaction, that is, a player does not select and direct any of the cards 152. The cards 152 are instead allowed to fall into open positions 62, 64, 66, 68 and 70 in the hands 56, 58 and 60. Another set of computerized simulations can be created to simulate when a player has the ability to place the cards 152 based on an optimum play strategy which assumes that a player adds a card to a hand 56, 58 or 60 if the card makes the hand a pat or the best possible winner. The computerized simulations can evaluate the dealt cards 152 against the contents of each hand 56, 58 and 60. If there is no pat winner or possible winner, the cards 152 are placed in a hand without a possible winner by the card game simulation computer program. The cards 152 are alternately placed in the hands 56, 58 and 60, beginning with hand 60, that is, the first card goes into hand 60, the second card goes into hand 58 and the third card goes into hand 56. If a card goes into a hand to make a possible winner, the next card goes in a different hand if the next card does not enhance the possible winner. The simulations can determine the volatility or pay back percentage of the game by comparing a simulation wherein two cards are dealt to each hand before a player has a chance of selecting and directing cards with a second simulation wherein a player begins a game with a first dealt card. By dealing the first two cards of each hand, the volatility and pay back percentage of the game is limited. Further, the perceived notion that a player can construct a Royal Flush or other hand every game is eliminated.

Figure 23:
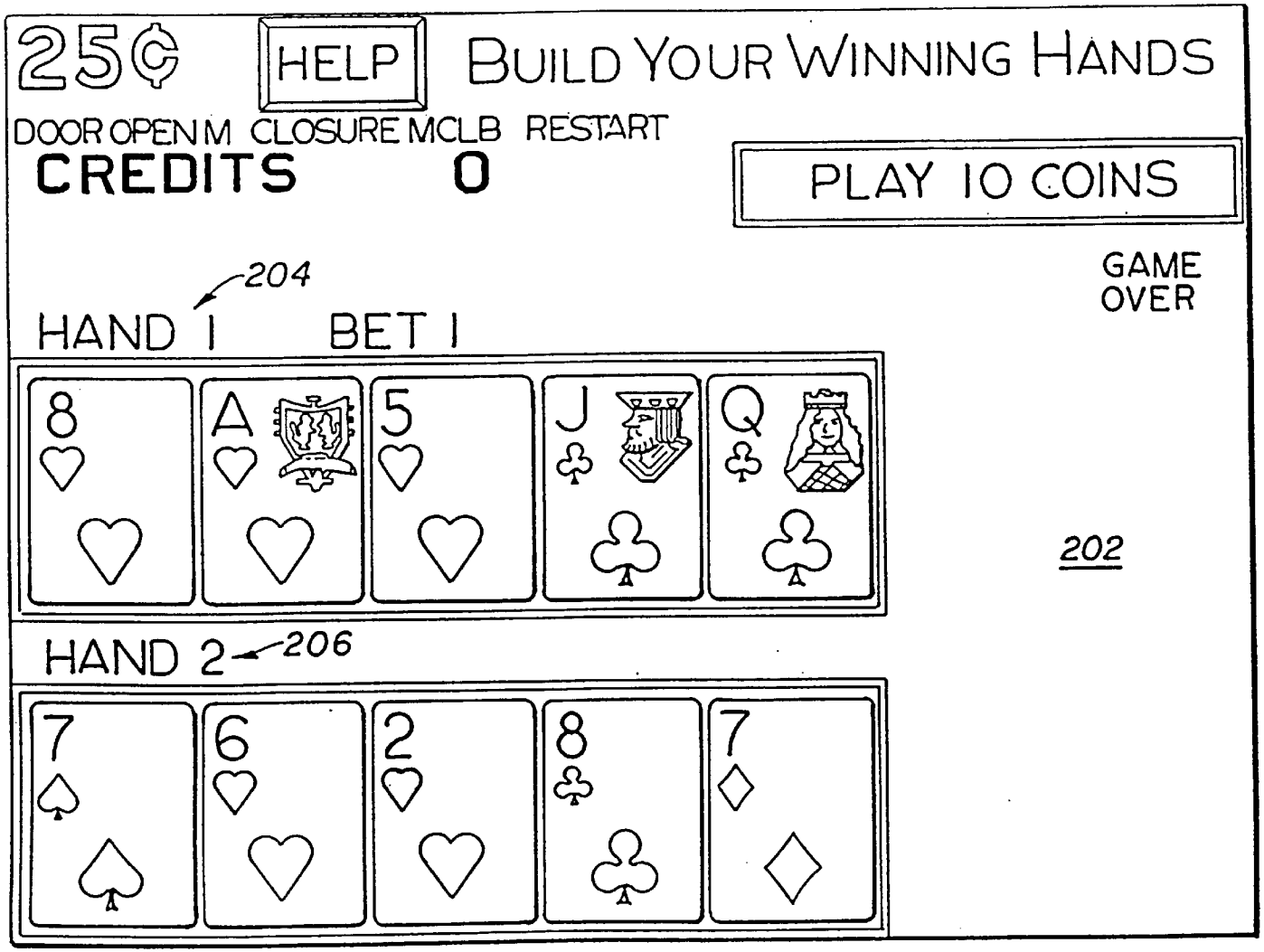
FIGS. 23–42 are screens generated by a game machine in accordance with an embodiment of the present invention.
Figure 24:
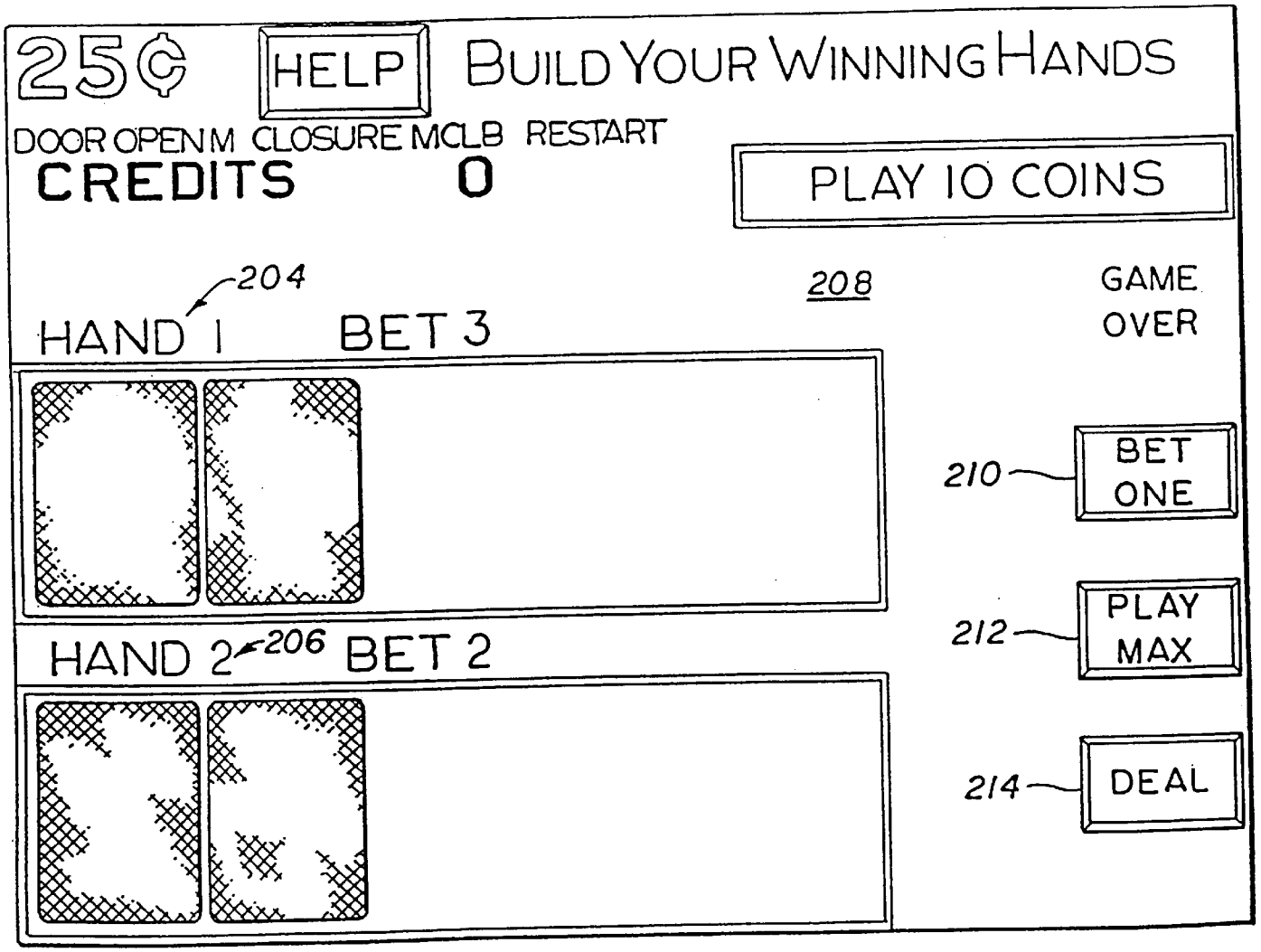
Figure 25:
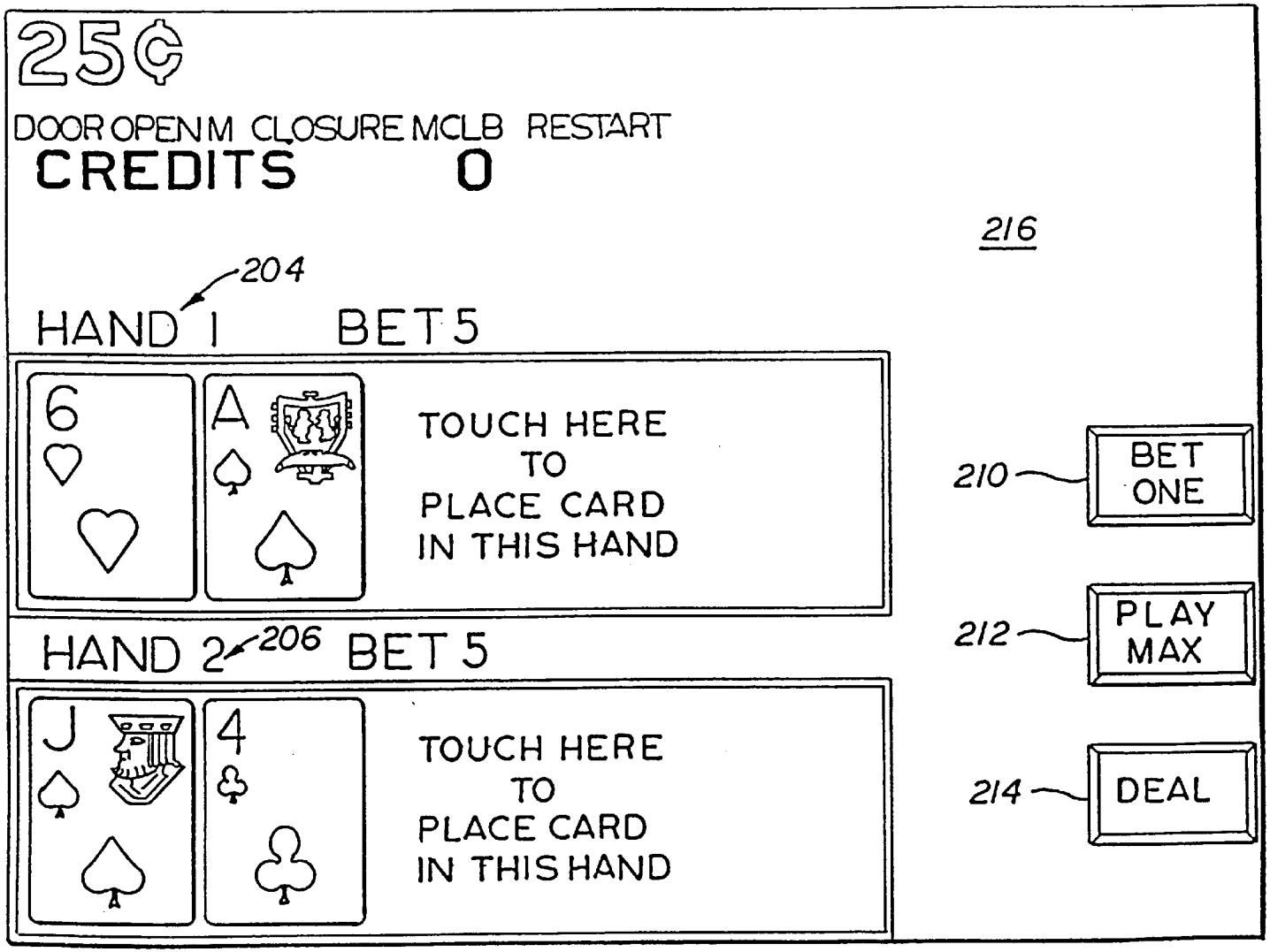
Figure 26:
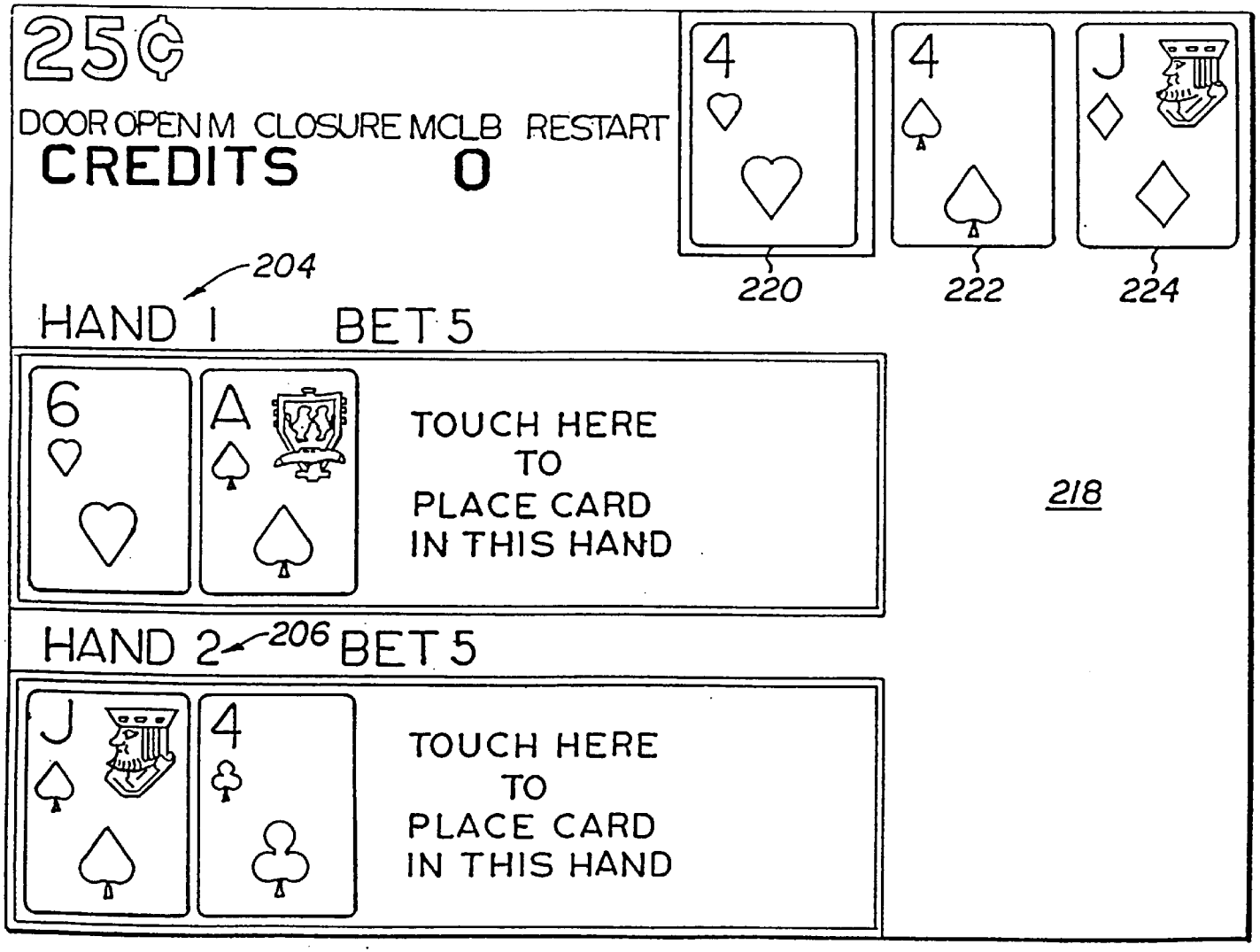
Figure 27:
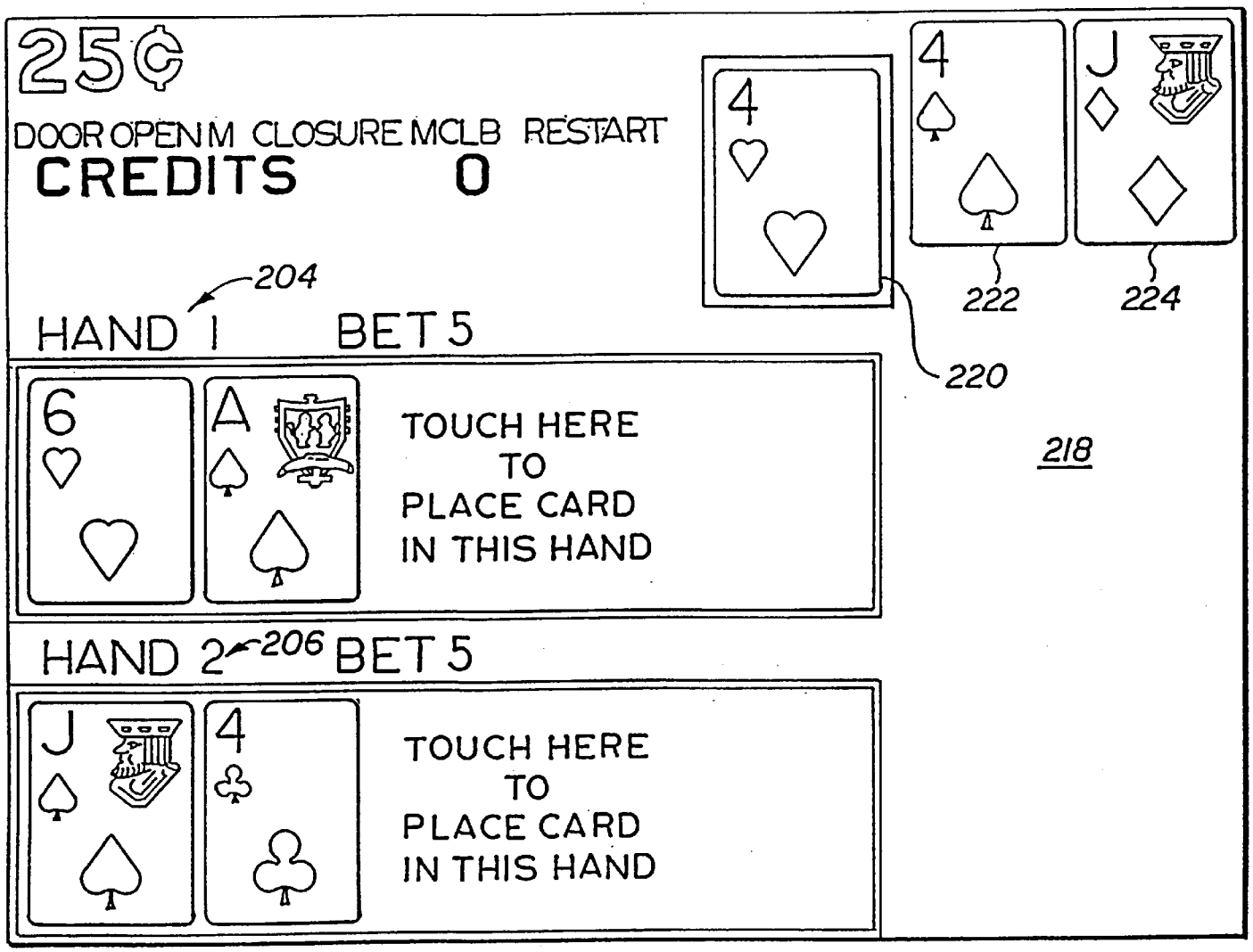
Figure 28:
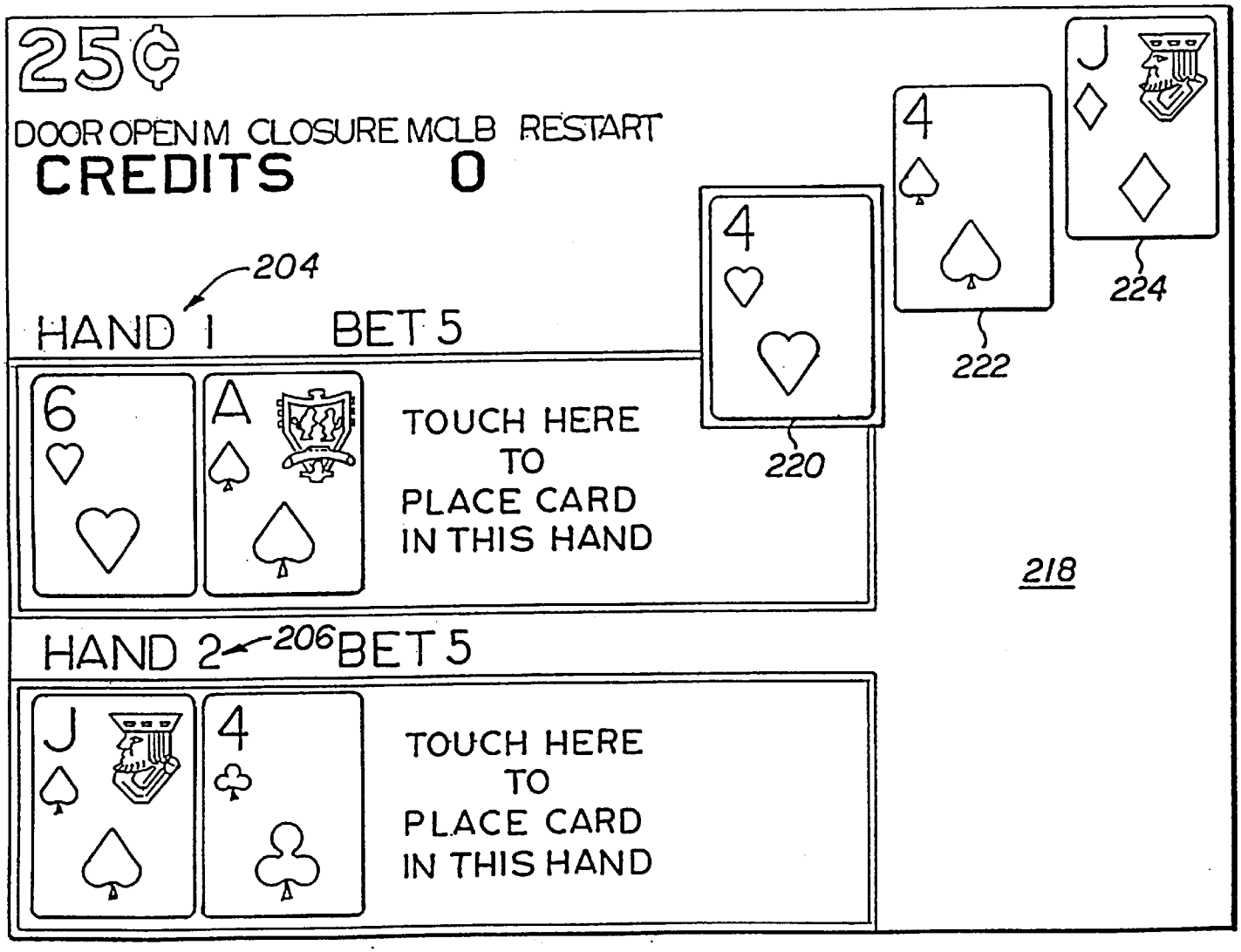
Figure 29:
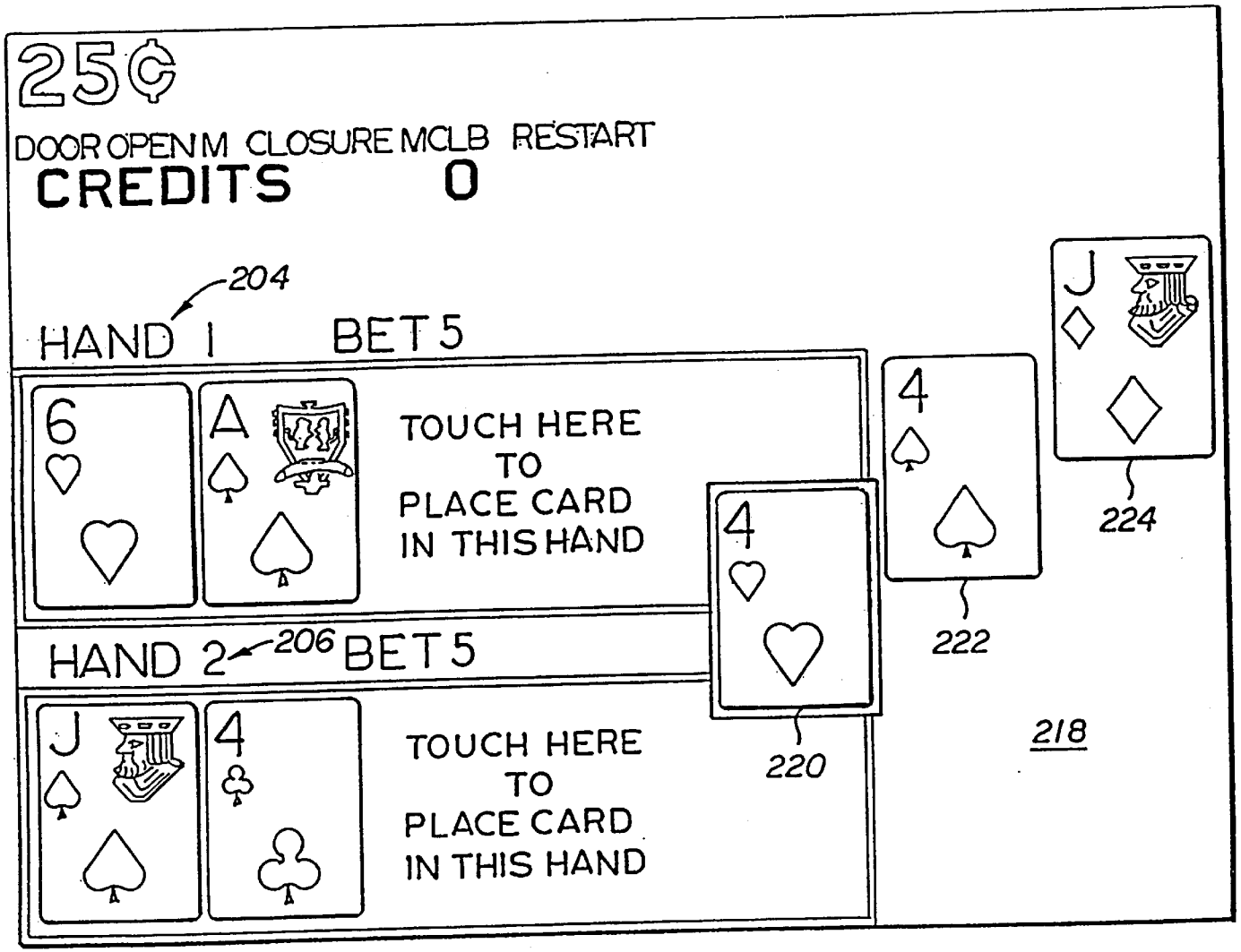

FIGS. 23 through 42 depict screens generated by processor 16 on the display device 20 in accordance with another embodiment of the present invention. As shown in FIG. 23, a game screen 202 is generated when the game machine 10 is not in use. The screen 202 preferably comprises two card hands 204 and 206 and the cards that were played in those hands during the most recent game. Game screen 208 in FIG. 24 is generated after money is deposited in the coin or bill receptor 28. In the illustrated embodiment, two cards are automatically dealt to each of the card hands 204 and 206. The card hands 204 and 206 each preferably comprises five card positions. A BET_ONE button 210, a PLAY_MAX button 212 and a DEAL button 214 are provided and operate in a manner described above in connection with buttons 86, 88 and 84 (FIG. 6). The dealt cards on the screen 208 are revealed to a player on the screen 216 in FIG. 25. The player can, for example, increase the bet amount to "5" after seeing the initially dealt cards by depressing the PLAY_MAX button 212, as shown in the screen 218 in FIG. 26. FIG. 26 also illustrates the next three cards 220, 222 and 224 to be dealt.

Figure 30:
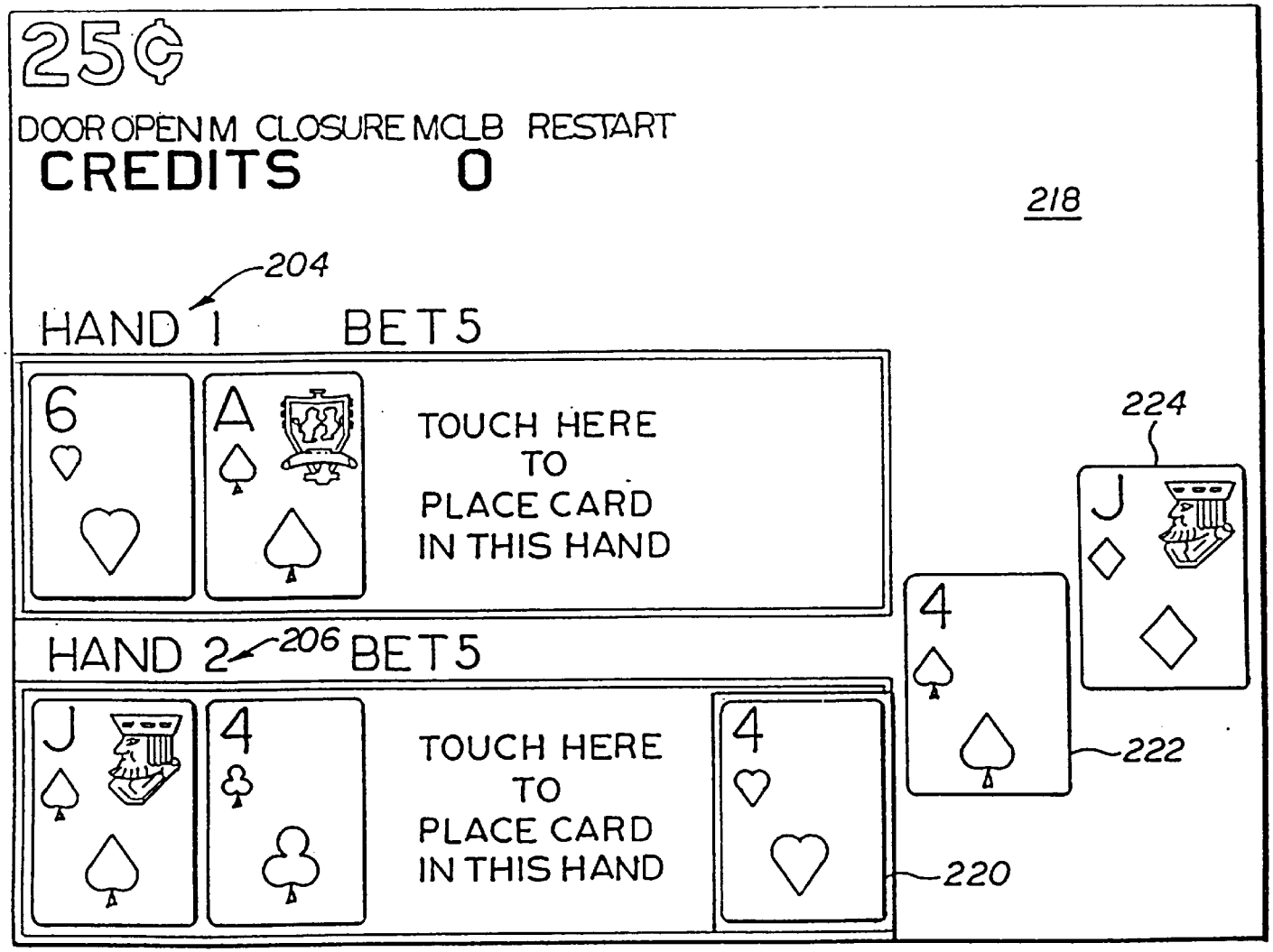
Figure 31:
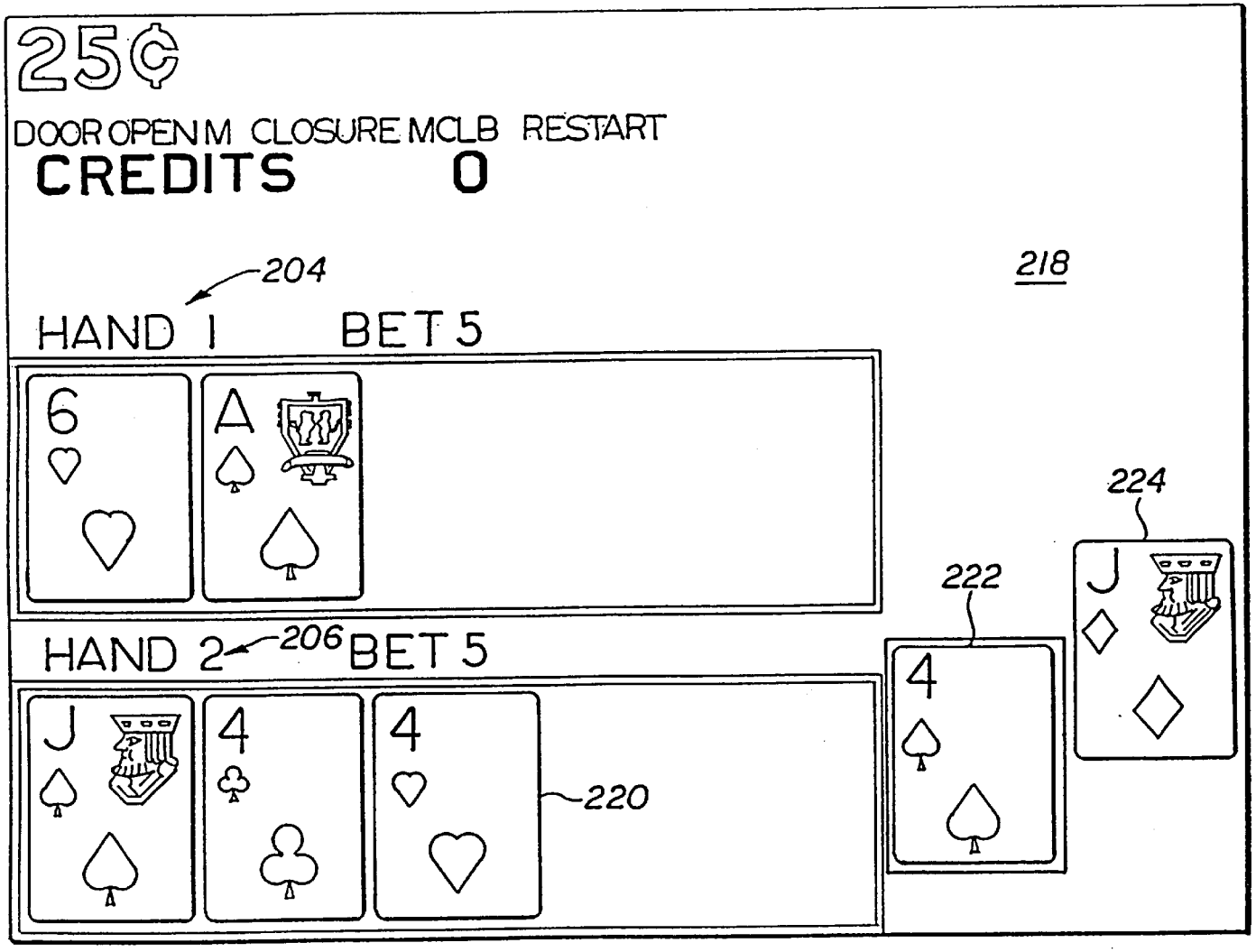
Figure 32:
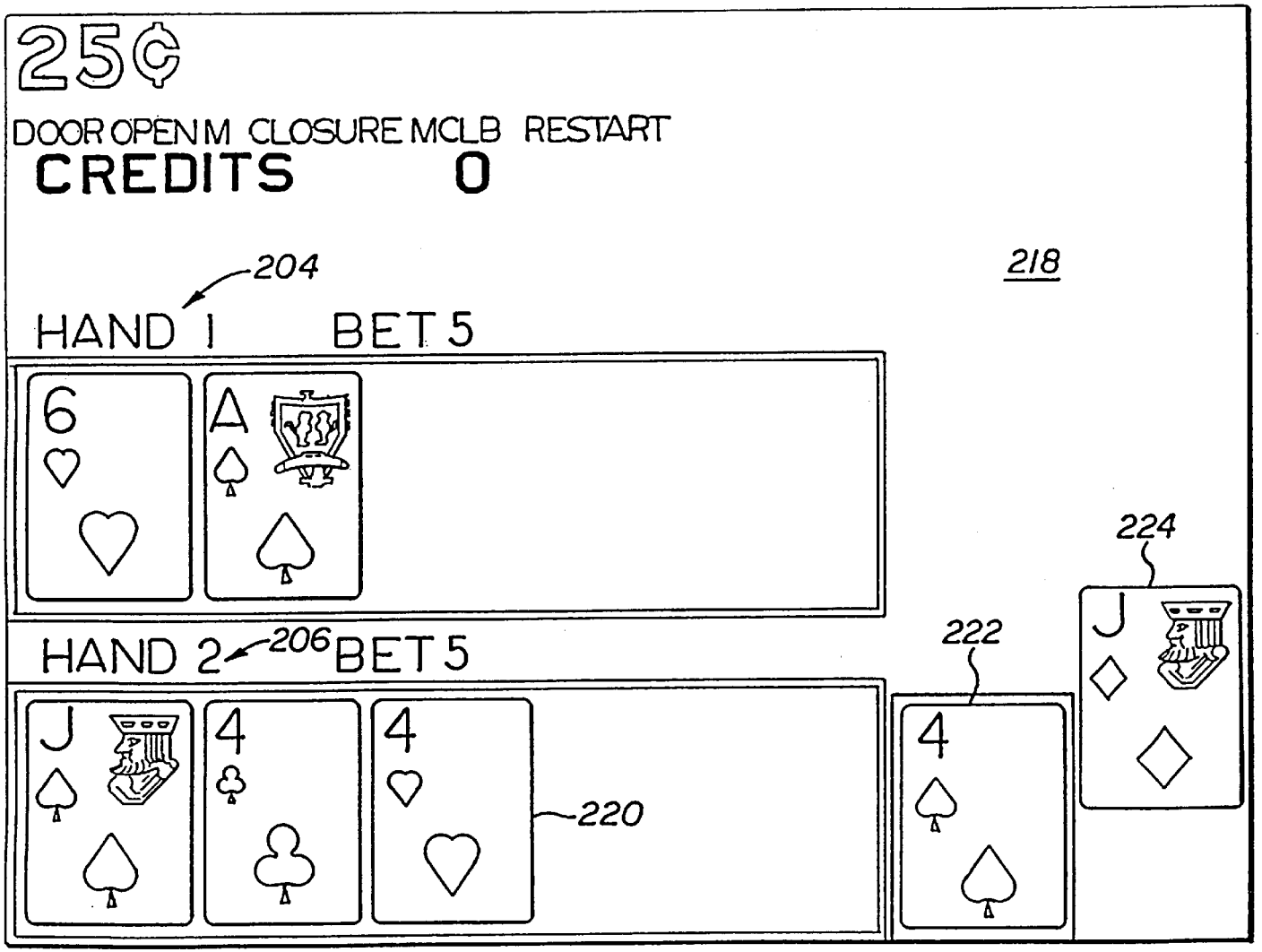
Figure 33:
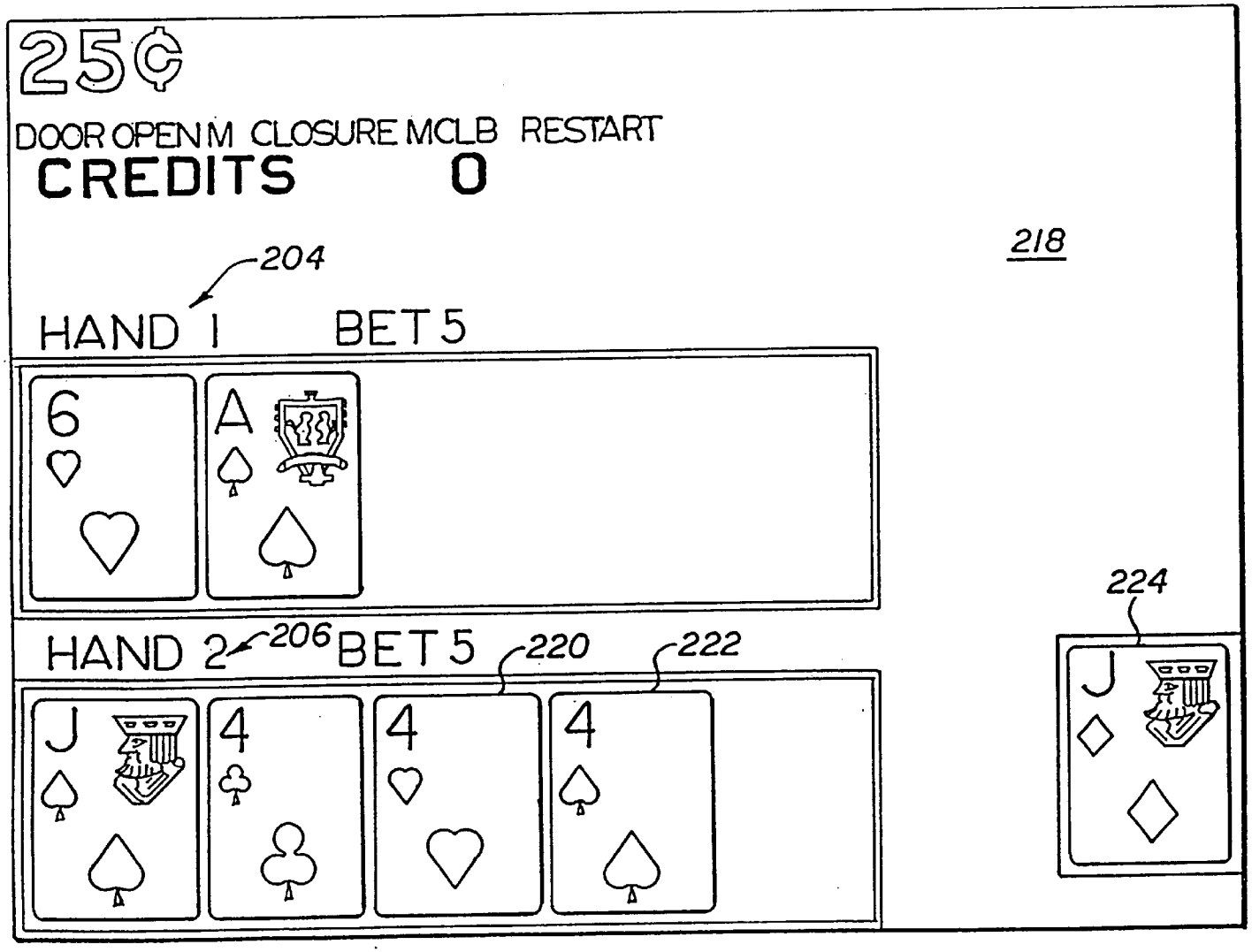
Figure 34:
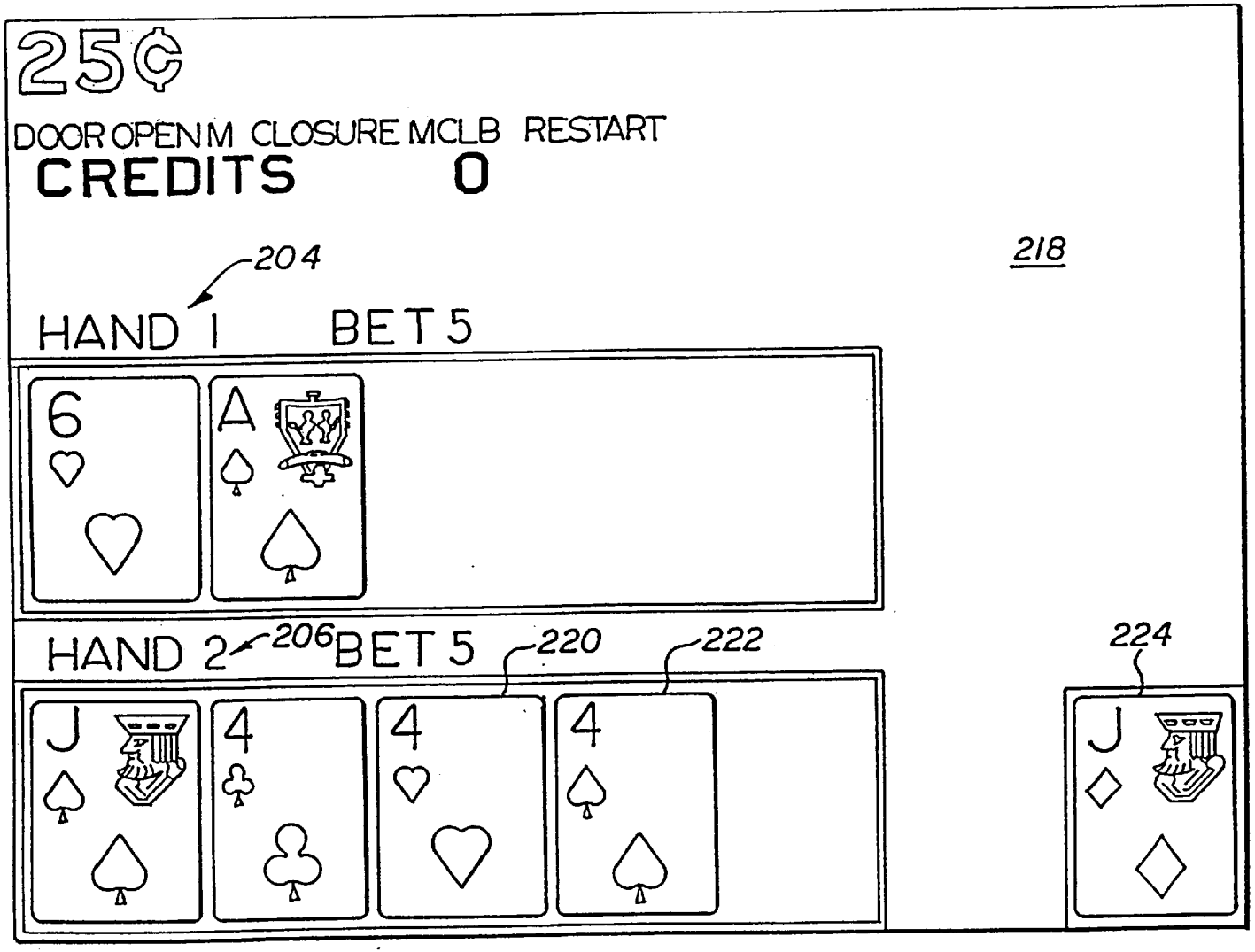
Figure 35:
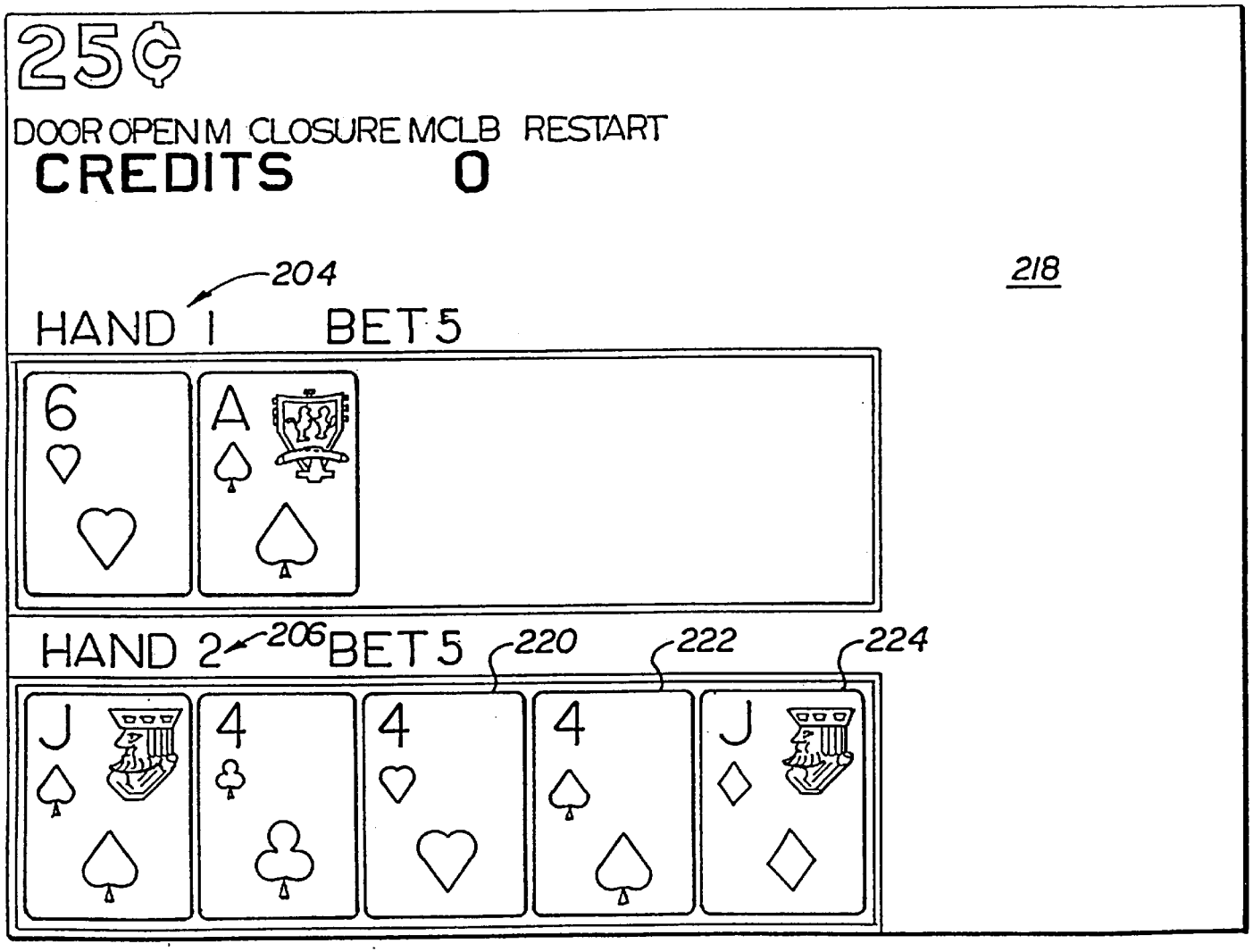
Figure 36:
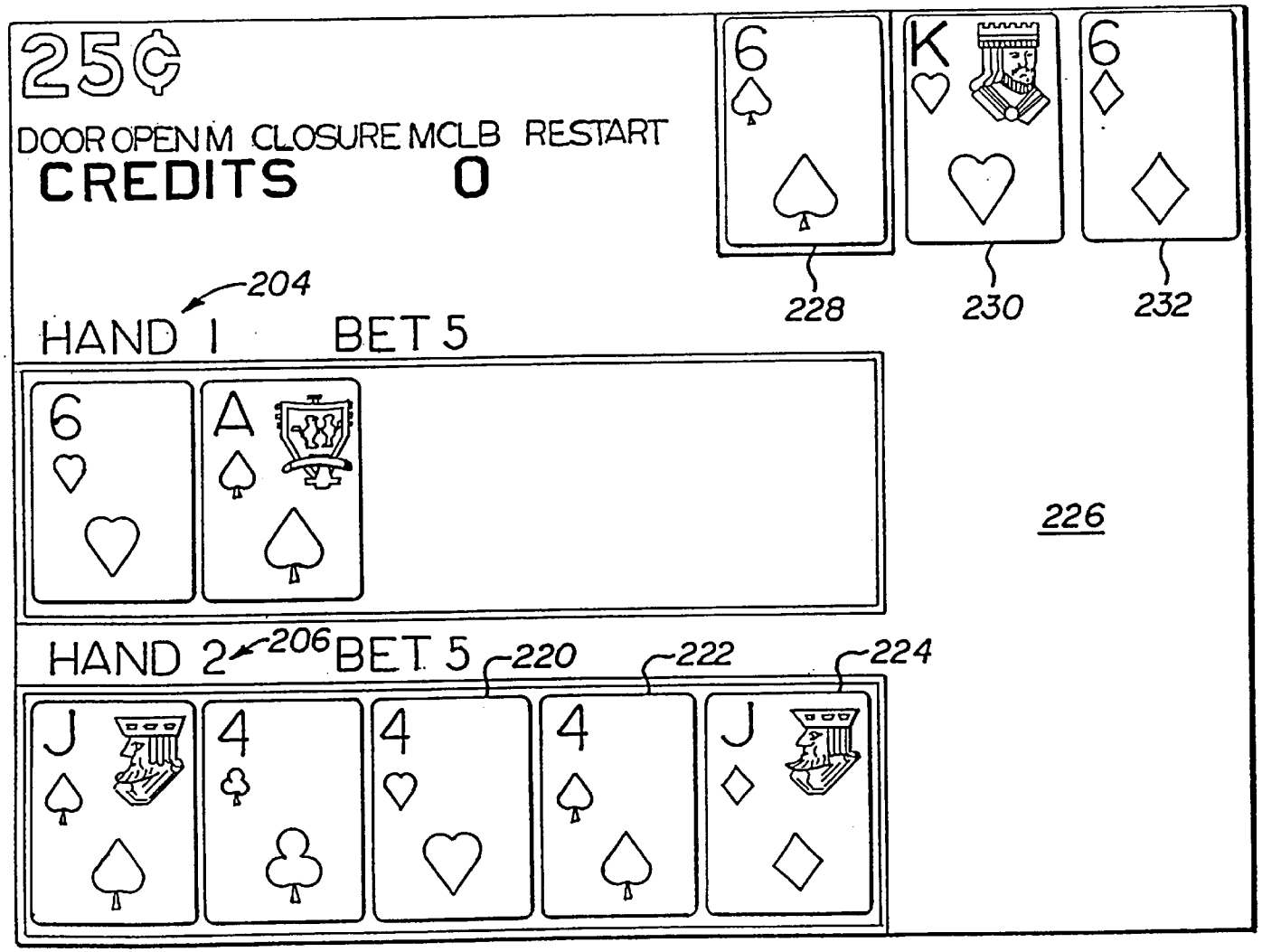
Figure 37:
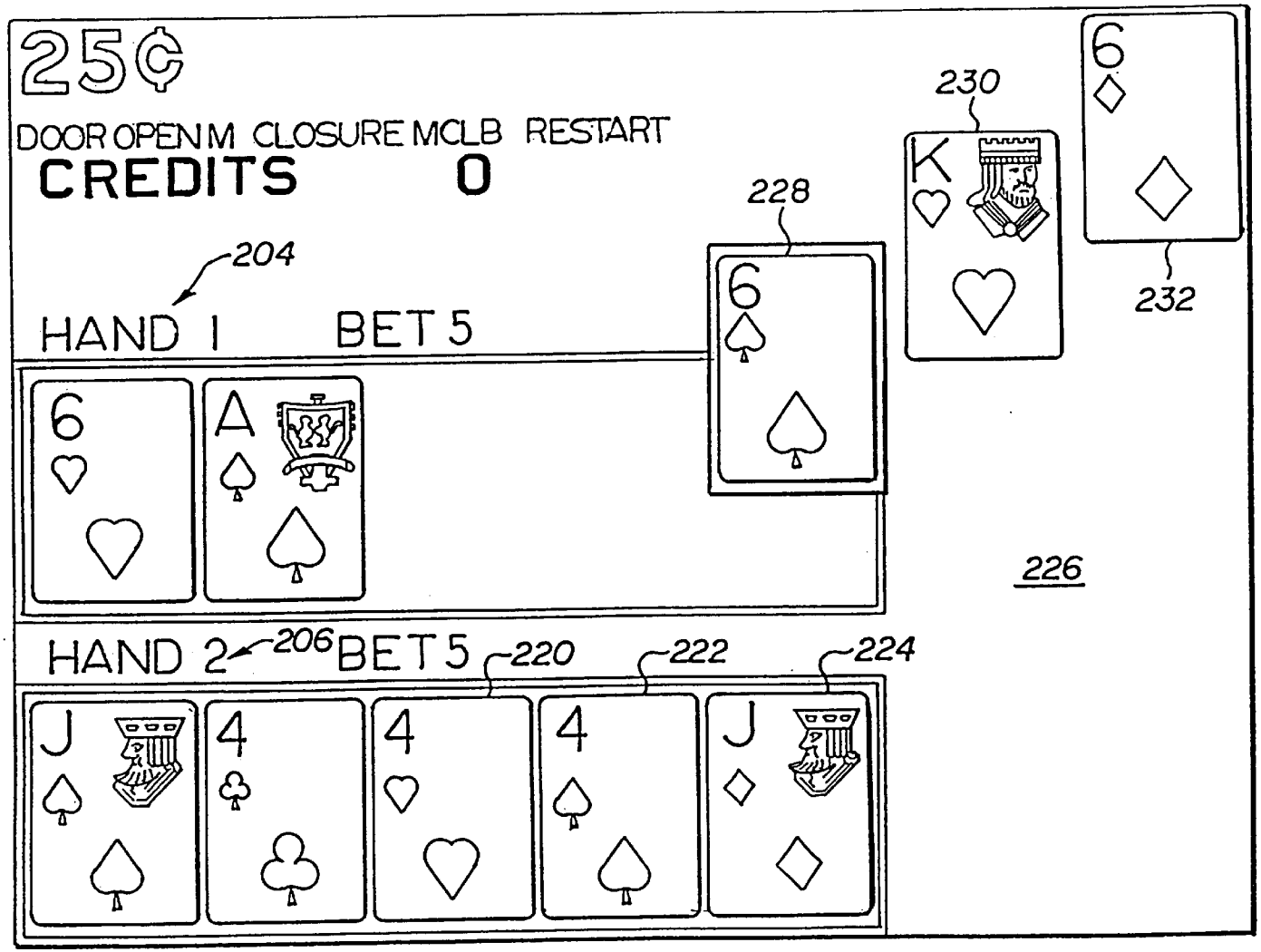
Figure 38:
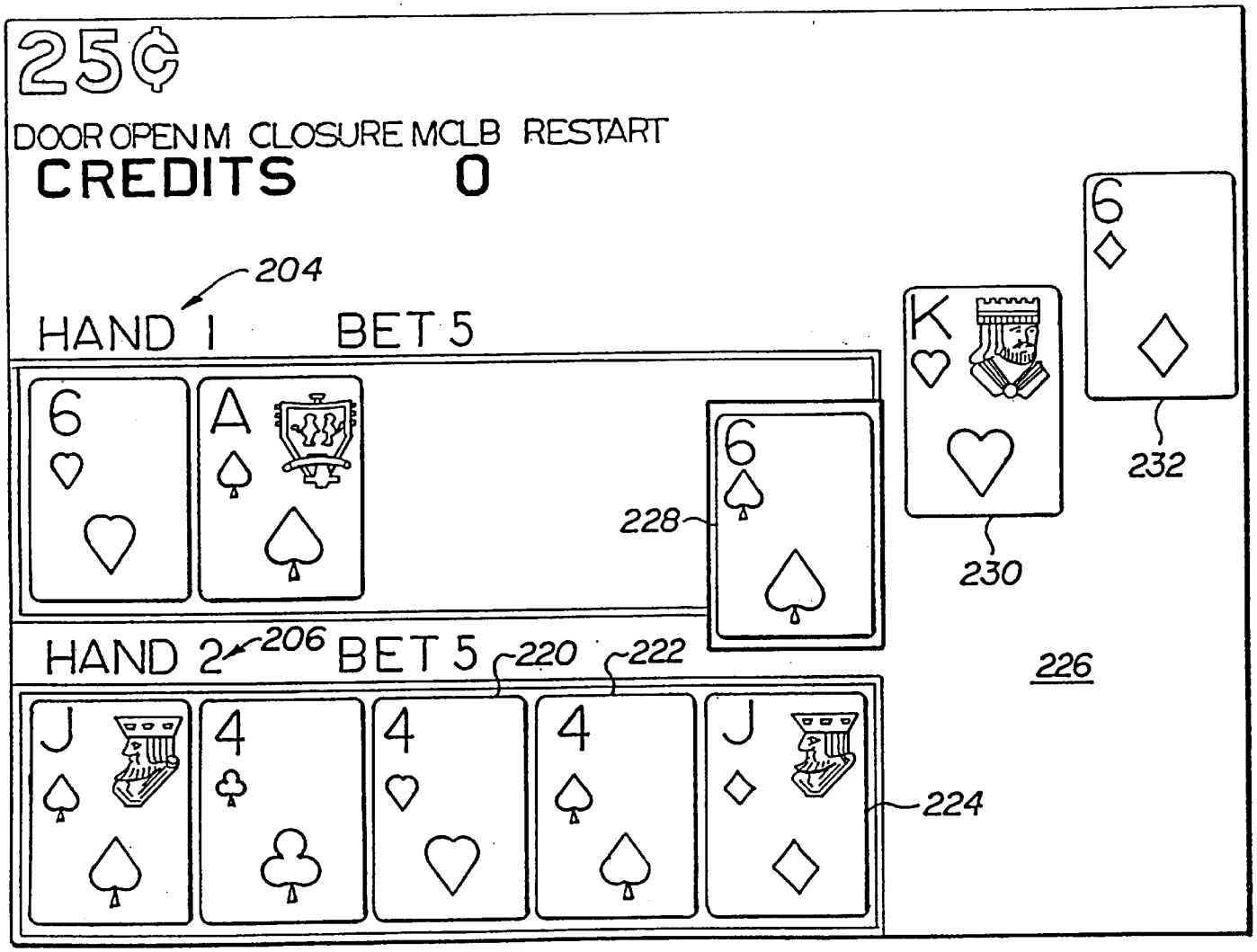
Figure 39:
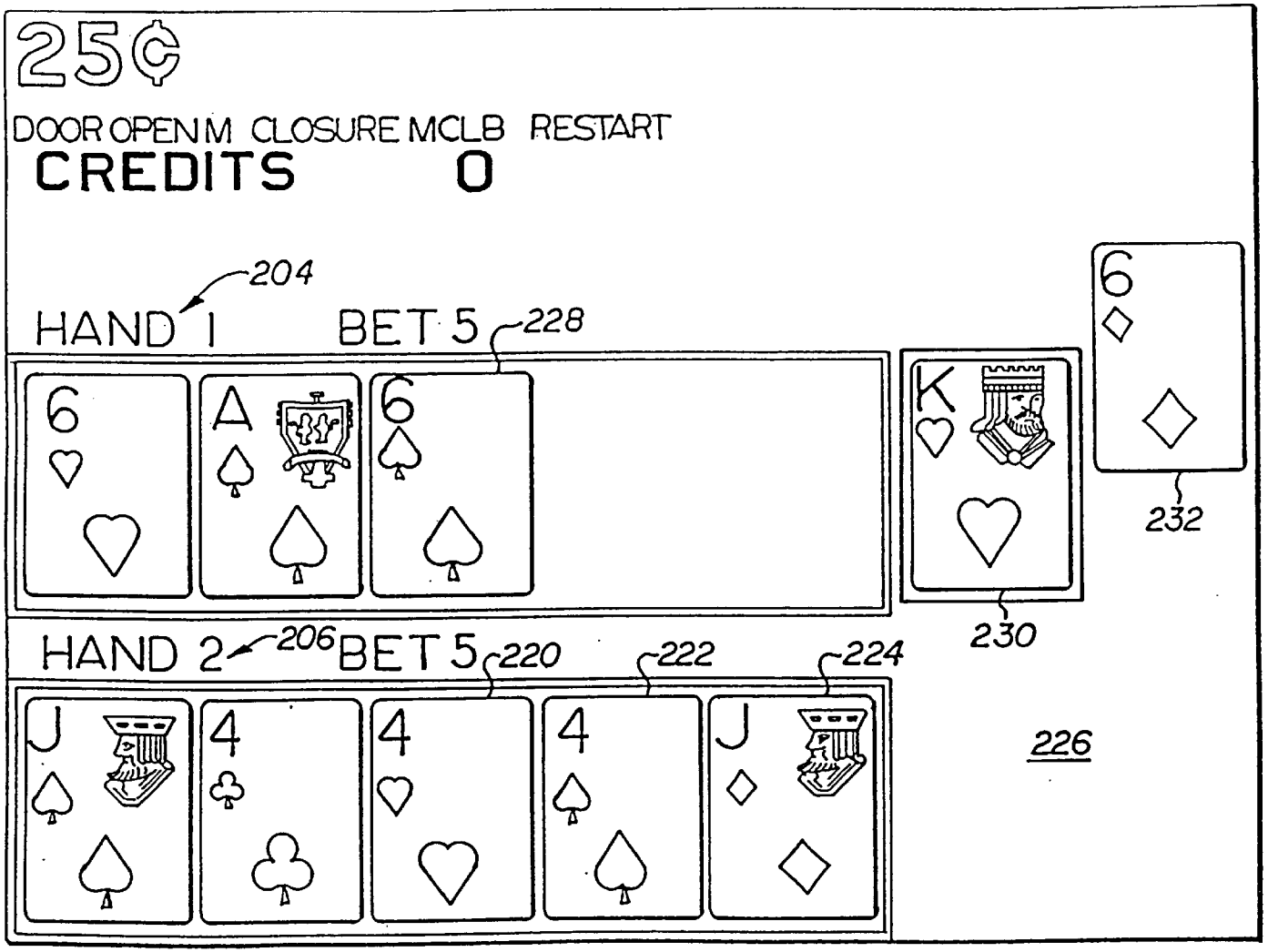
Figure 40:
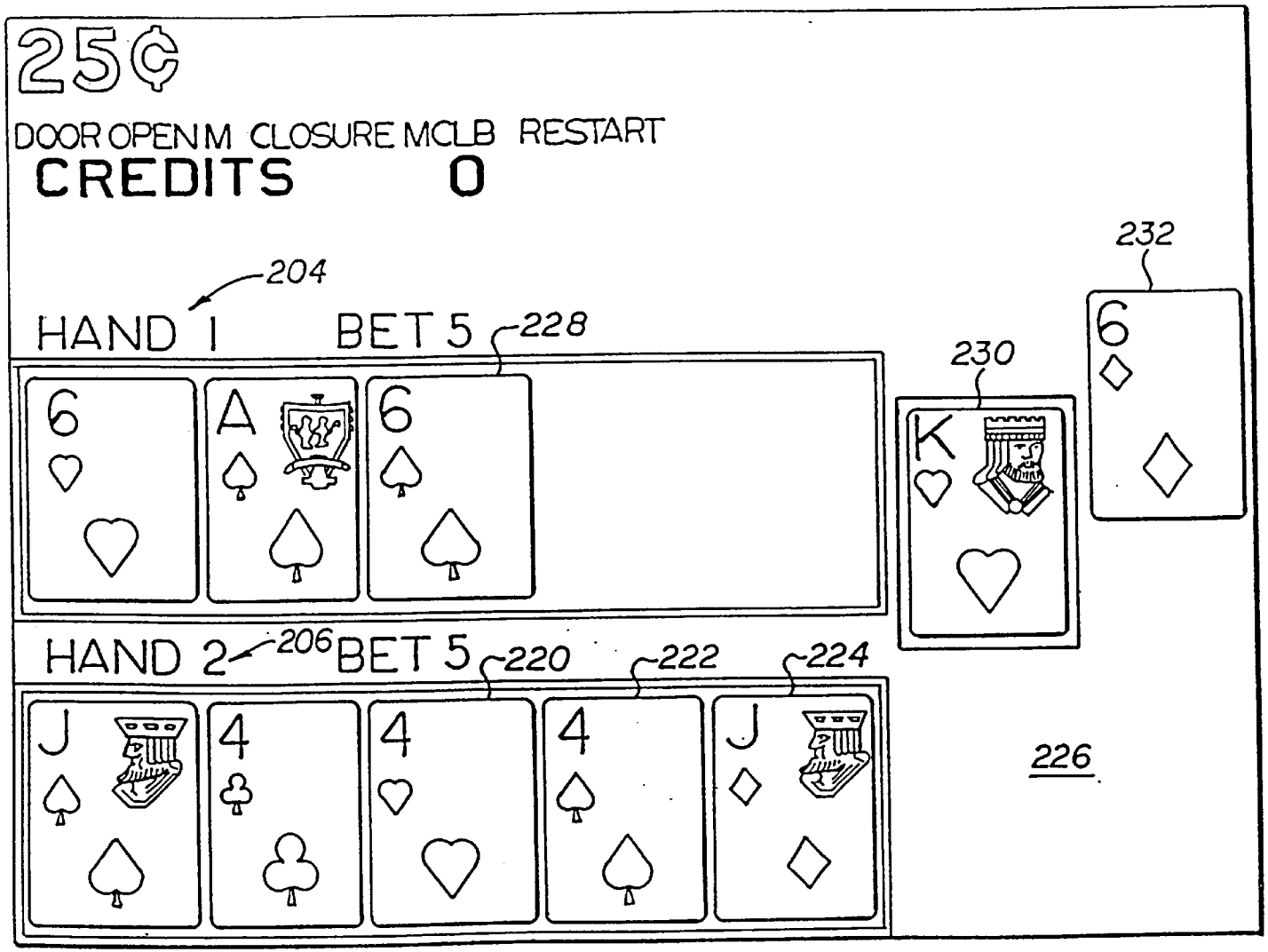
Figure 41:
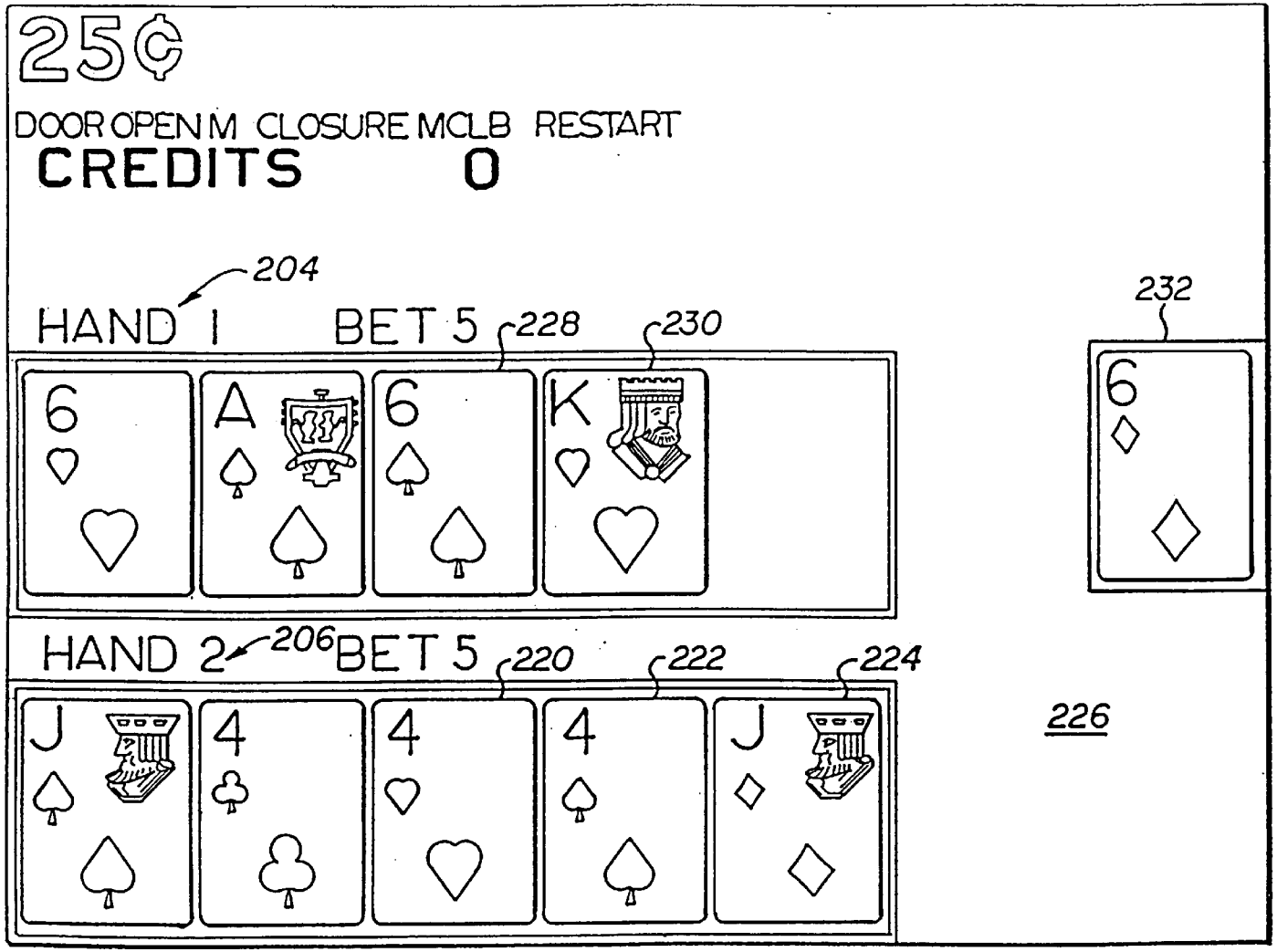
Figure 42:
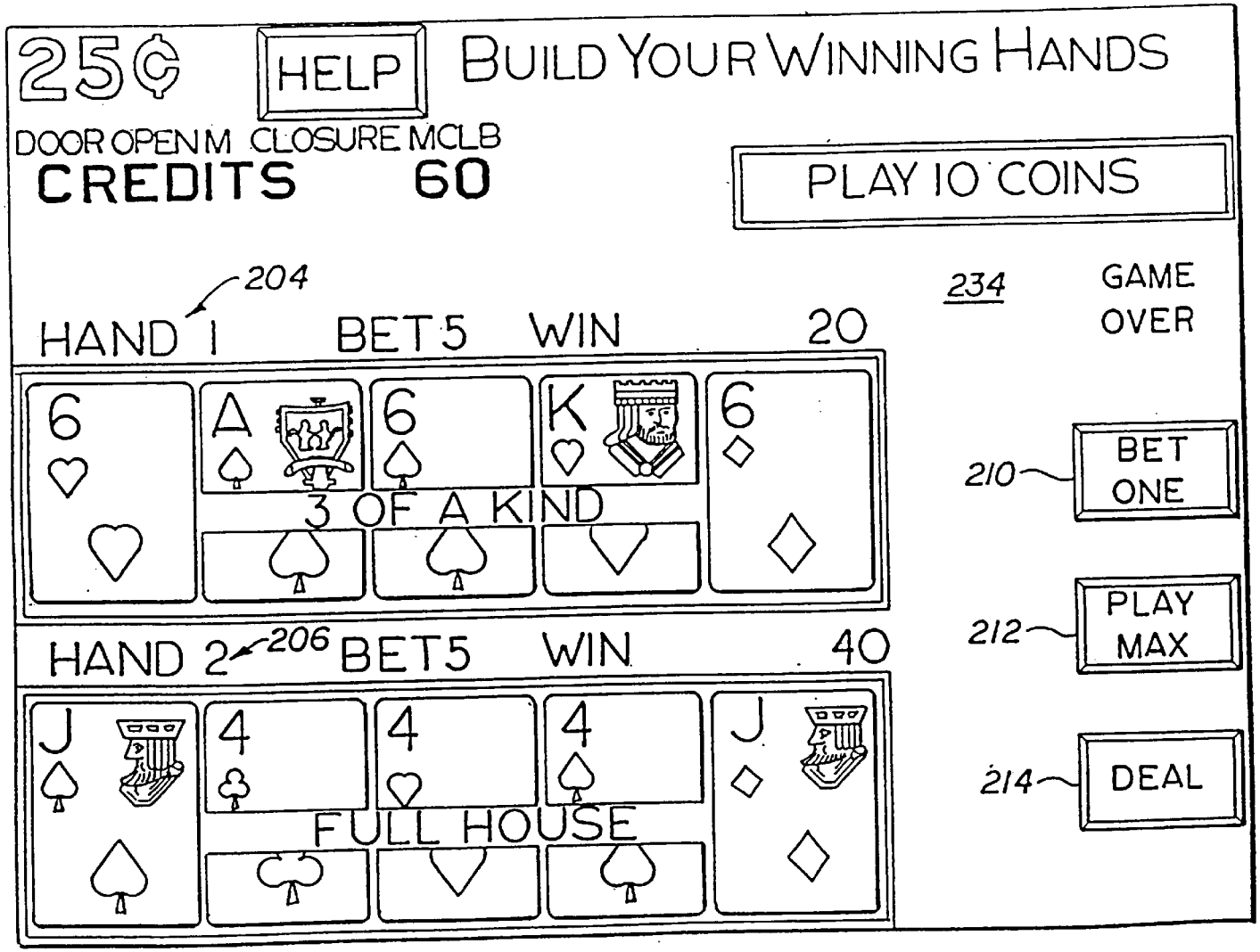

FIGS. 27 through 35 illustrate how the screen 218 changes over a period of time as the processor generates images of cards 220, 222 and 224 moving along a predetermined path on the screen 218 toward a final card position at the bottom thereof, for example. The cards 220, 222 and 224 preferably commence movement on the screen 218 in a sequential manner, with the card 220 moving first and the other two cards 222 and 224 following. A player can touch that portion of the screen corresponding to the card hand 206, or use another input device besides a touchscreen 30, or allow the processor 16 to automatically place the card 220 in the card hand 206 to create a pair (Fig.30). The cards 222 and 224 are also placed in the card hand 204 to create a full house, as shown in FIGS. 33 and 35, respectively.

FIGS. 36 through 41 illustrate a screen 226 displaying another set of dealt cards 228, 230 and 232. The cards are placed in the card hand 204. The processor 16 subsequently computes the game total for a three-of-a-kind card hand and a full house card hand at the conclusion of the game. The game total is displayed as shown in the screen 234 in FIG. 42.

While certain advantageous embodiments have been chosen to illustrate the invention, it will be understood by those skilled in the art that various changes and modifications can be made herein without departing from the scope of the invention as defined in the appended claims.

What is claimed is:

1. A method of playing an electronic card game using one or more decks of playing cards including at least one of a plurality of card suits and different point values for cards within a suit, the electronic card game being characterized by rules for using the playing cards, the method comprising the steps of:

displaying first and second player hands on a screen, said first and second player hands each comprising n-x cards randomly selected by a processor, n corresponding to an integer value of cards constituting a full hand in accordance with said rules for playing said electronic card game, and x corresponding to an integer value selected from the range $1 \leqq x \leqq n$;

generating an image of a card randomly selected from said deck and moving along a path on said screen; and selecting which of said first and second player hands in which to place said moving card using an input device.

2. A method is claimed in claim 1, wherein said moving card is placed in one of said first and second player hands automatically by said processor if said player does not select one of said first and second player hands in which to place said moving card traverses a predetermined length of said path on said screen.

3. A method as claimed in claim 1, wherein said moving card is placed in one of said first and second player hands automatically by said processor if said player does not select which of said first and second player hands in which to place said moving card before a predetermined period of time expires.

4. A method as claimed in claim 1, wherein the rate at which said moving card moves is variable.

5. A method as claimed in claim 4, wherein said rate is selectable by one of said player and said processor in accordance with program code.

6. A method as claimed in claim 4, wherein said processor increases said rate in response to a condition selected from the group consisting of an increase in skill level of said player as specified by said player, an increase in the number of points earned, by increasing duration of said card game.

7. A method as claimed in claim 1, comprising the step of controlling the movement of said card into said selected hand using a user input device.

8. A method as claimed in claim 1, wherein said generating step comprises the step of moving said card toward at least one of said first and second player hands.

9. A method as claimed in claim 8, wherein said moving card is placed in one of said first and second player hands automatically by said processor if said player does not select one of said first and second player hands in which to place said moving card before said moving card reaches the most proximal of said first and second player hands on said screen.

10. An electronically controlled game apparatus adapted to play an electronic card game comprising:

a screen display device;

a processor electrically connected to said display device and operable to generate images of cards moving along a path on said display device; and a user input device electrically connected to said processor to generate control signals corresponding to where on said display device a player wishes to direct a selected one of said moving cards, said processor being programmable to place said moving card in accordance with said control signals.

11. A game apparatus as claimed in claim 10, wherein said processor is programmable to generate an image of said card moving along a predetermined length of said path in a predetermined period of time, and to automatically place said card in one of a plurality of player hand locations on said display device if said control signals are not received by said processor within said predetermined period of time.

12. A game apparatus as claimed in claim 11, wherein said processor is programmable to vary said predetermined period of time in response to one of a plurality of conditions comprising length of game play, amount of bet, number of cards in hand, pay table, number of hands played simultaneously, and skill level of said player wherein said skill level of said player is one of at least a first skill level and a second skill level that is less than said first skill level, said predetermined period of time being varied to be less for said first skill level than for said second skill level.

13. A game apparatus as claimed in claim 10, wherein said processor is programmable to generate an image of at least one of said cards moving toward at least one of a plurality of player hand locations on said display device.

14. A game apparatus as claimed in claim 13, wherein said processor is programmable to automatically place said at least one of said cards in one of said plurality of player hand locations if said control signals are not received by said processor within a predetermined period of time.

* * * * *